US007415235B2

(12) United States Patent
Aze et al.

(10) Patent No.: US 7,415,235 B2
(45) Date of Patent: Aug. 19, 2008

(54) IMAGE FORMING METHOD AND APPARATUS, IMAGE FIXING UNIT, AND INDUCTION HEATER USED THEREIN

(75) Inventors: Norihiko Aze, Zama (JP); Motokazu Hasegawa, Atsugi (JP); Hidenori Machida, Ebina (JP)

(73) Assignee: Ricoh Co., Ltd., Tokyo (JP)

( * ) Notice: Subject to any disclaimer, the term of this patent is extended or adjusted under 35 U.S.C. 154(b) by 327 days.

(21) Appl. No.: 11/221,687

(22) Filed: Sep. 9, 2005

(65) Prior Publication Data

US 2006/0056890 A1 Mar. 16, 2006

(30) Foreign Application Priority Data

Sep. 10, 2004 (JP) ..... 2004-263153

(51) Int. Cl.
*G03G 15/20* (2006.01)

(52) U.S. Cl. ..... 399/329; 219/216; 399/330

(58) Field of Classification Search ..... 399/67, 399/69, 328, 329, 330; 219/216, 469, 619
See application file for complete search history.

(56) References Cited

U.S. PATENT DOCUMENTS 4,570,044 A * 2/1986 Kobayashi et al. ..... 219/619
5,752,150 A * 5/1998 Kato et al. ..... 399/330
6,810,230 B2 * 10/2004 Imai et al. ..... 399/328
6,861,124 B2 3/2005 Kamiya et al.
2003/0235417 A1 12/2003 Aze et al.
2004/0129062 A1 7/2004 Aze et al.
2004/0224165 A1 11/2004 Kondoh et al.
2005/0286938 A1 * 12/2005 Aze et al. ..... 399/328

FOREIGN PATENT DOCUMENTS

| | | |
|---|---|---|
| JP | 2001-135471 | 5/2001 |
| JP | 2001-249565 | 9/2001 |
| JP | 2002-006658 | 1/2002 |
| JP | 2002-082549 | 3/2002 |
| JP | 2003-076173 | 3/2003 |

* cited by examiner

*Primary Examiner*—Hoan H Tran
(74) *Attorney, Agent, or Firm*—Oblon, Spivak, McClelland, Maier & Neustadt, P.C.

(57) ABSTRACT

An image forming apparatus includes a fixing unit for fixing a toner image on a recording sheet. In the fixing unit, a magnetic flux generator generates a magnetic flux to induce heat in a support roller. The heat is transferred to a fixing belt contacting the support roller. The recording sheet having the toner image is inserted between the fixing belt and a pressure roller facing the fixing belt. A holder holds the magnetic flux generator and positions the magnetic flux generator to face outer and inner circumferential surfaces of the support roller.

35 Claims, 12 Drawing Sheets

IMAGE FORMING METHOD AND APPARATUS, IMAGE FIXING UNIT, AND INDUCTION HEATER USED THEREIN

CROSS-REFERENCE TO RELATED APPLICATIONS

The present application is based on and claims priority to Japanese patent application No. 2004-263153 filed on Sep. 10, 2004 in the Japan Patent Office, the entire contents of which are hereby incorporated herein by reference.

BACKGROUND OF THE INVENTION

1. Field of the Invention

The present invention relates to a method and apparatus for image forming, and more particularly to a method and apparatus for image forming capable of effectively fixing a toner image on a recording sheet by using induction heating in a fixing unit providing improved efficiency in heating and maintenance. The present invention also relates to the fixing unit and an induction heater used therein.

2. Description of the Background Art

Background image forming apparatuses, such as copiers and printers, include fixing units using an induction heating method. The induction heating method may shorten a time period required for the fixing units to become operable after the fixing units are powered on, and may reduce an energy consumption.

One example of the fixing units includes a fixing belt, a support roller, an auxiliary fixing roller, an induction heater, and a pressure roller. The fixing belt is laid across the support roller and the auxiliary fixing roller. The induction heater faces the support roller via the fixing belt. The pressure roller faces the auxiliary fixing roller via the fixing belt. The induction heater includes an exciting coil and a core. The exciting coil is provided along the core and extends in directions parallel to a surface of a recording sheet in conveyance and perpendicular to a conveyance direction of the recording sheet which is conveyed between the pressure roller and the auxiliary fixing roller.

A high-frequency alternating current is applied to the exciting coil to generate a magnetic field around the exciting coil. The magnetic field induces an eddy current near a surface of the support roller. An electrical resistance of the support roller generates Joule heat. The Joule heat is transferred to the fixing belt from the support roller. The heated fixing belt heats and fixes a toner image on the recording sheet at a position where the pressure roller and the auxiliary fixing roller oppose to each other.

In the above fixing unit, it is possible to increase a surface temperature of the fixing belt to a target fixing temperature in a short time period without consuming much energy. However, the exciting coil may face the support roller at variable positions, resulting in a fluctuation of the heating efficiency.

Another example of fixing units includes a fixing roller and an exciting coil. The fixing roller includes a hollow cylinder. The exciting coil includes a wire wound around the fixing roller a plurality of times, so that the exciting coil faces outer and inner circumferential surfaces of the fixing roller.

In the above fixing unit, it is possible to effectively increase a surface temperature of the fixing roller. However, once the wire is wound around the fixing roller, the wire cannot be separated from the fixing roller, resulting in inefficient maintenance operations.

In the above fixing units, a temperature of a part of the fixing belt or the fixing roller may overly increase when the image fixing is conducted a number of times in a consecutive manner relative to smaller-size recording sheets. A temperature of the whole fixing belt or fixing roller may overly increase when the fixing unit accidentally stops operating due to a paper jam.

SUMMARY OF THE INVENTION

This specification describes novel image forming apparatus and method for fixing an image. According to one aspect of the present invention, the novel image forming apparatus includes an image forming unit and a fixing unit. The image forming unit forms a toner image on a recording sheet. The fixing unit fixes the toner image on the recording sheet. The fixing unit includes an induction heater and a heater. The induction heater generates a magnetic field. The heater generates heat when placed in the magnetic field. The induction heater include a magnetic flux generator and a holder. The magnetic flux generator generates a magnetic flux to heat the heater and is disposed to surround the heater. The holder holds the magnetic flux generator and positions the magnetic flux generator against the heater.

The holder may hold the heater. The image forming apparatus may further include a positioner. The positioner may be configured to position the holder and the heater in the fixing unit. The induction heater may be attachable and detachable to and from the heater through one end in an axial direction of the heater.

The magnetic flux generator may be formed in a U-like shape and the heater may be placed in a gap of the magnetic flux generator. The magnetic flux generator may include one or more U-like shape members. The magnetic flux generator may be formed in a loop-like shape and the heater may be placed inside a loop of the magnetic flux generator.

The induction heater may be integrated with the heater. The induction heater and the heater may be attachable and detachable to and from the fixing unit through one end in the axial direction of the heater. The magnetic flux generator may wind around front and back surfaces of the heater for a plurality of times.

The image forming apparatus may further include a power source and a connector. The power source may be configured to apply an alternating current to the magnetic flux generator. The connector may be configured to connect the magnetic flux generator with the power source and held by the holder. The connector may connect the magnetic flux generator with the power source to form one alternating current channel in the magnetic flux generator. The connector may include two input-output terminals.

The holder may hold the magnetic flux generator to create a gap between the magnetic flux generator and each of the front and back surfaces of the heater in a direction perpendicular to the axial direction of the heater in a range of 0.5 mm to 50 mm.

The magnetic flux generator may include a plurality of single wires bunched, twisted, and insulated to each other. The magnetic flux generator may include copper. The holder may include a heat-resistant, non-magnetic material. The non-magnetic material may include any one of a polyimide resin, a polyamide resin, a polyamide-imide resin, a PEEK (polyetheretherketone) resin, a PES (polyethersulfone) resin, a PPS (polyphenylene sulfide) resin, a PBI (polybenzimidazole) resin, and ceramic.

The heater may include a heating layer. The heating layer may be configured to generate heat by the magnetic flux generated by the magnetic flux generator and to have a Curie point not greater than 300 degrees centigrade. The heating layer may include a magnetic shunt alloy.

The image forming apparatus may further include a fixing member. The fixing member may be configured to melt the toner image and heated by the heater. The image forming apparatus may further include an auxiliary fixing roller. The auxiliary fixing roller may be configured to support the fixing member. The fixing member may be formed in a belt shape and extended in an endless loop form. The heater may be formed in a roller shape and configured to support the fixing member.

The magnetic flux generator may be disposed at a position facing an outer circumferential surface of the heater via the fixing member and an inner circumferential surface of the heater.

The image forming apparatus may further include a pressure roller. The pressure roller may be configured to apply pressure to the recording sheet conveyed. The auxiliary fixing roller may receive the pressure from the pressure roller via the recording sheet and the fixing member.

The image forming apparatus may further include at least two rollers. The rollers may be configured to support the fixing member. The magnetic flux generator may be disposed at a position facing outer and inner circumferential surfaces of the fixing member. The rollers may include a support roller and the auxiliary fixing roller. The support roller may be configured to support the fixing member at one end of the endless loop form. The auxiliary fixing roller may be configured to support the fixing member at another end of the endless loop form and to receive the pressure from the pressure roller via the recording sheet and the fixing member.

The magnetic flux generator may be disposed at a position facing the inner circumferential surface of the fixing member via the support roller. The fixing member may be formed in a roller shape contacting the pressure roller. The magnetic flux generator may be disposed at a position facing the outer and inner circumferential surfaces of the fixing member.

In another aspect of the present invention, the novel image forming method includes the steps of forming a toner image on a recording sheet and fixing the toner image on the recording sheet. The fixing step includes the sub-steps of generating a magnetic flux by applying an alternating current to a magnetic flux generator held and positioned by a holder so as to surround a heater to heat the heater by the magnetic flux to a predetermined temperature, and consecutively rotating the heater to fix the toner image on the recording sheet by a portion of the heater having the predetermined temperature.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
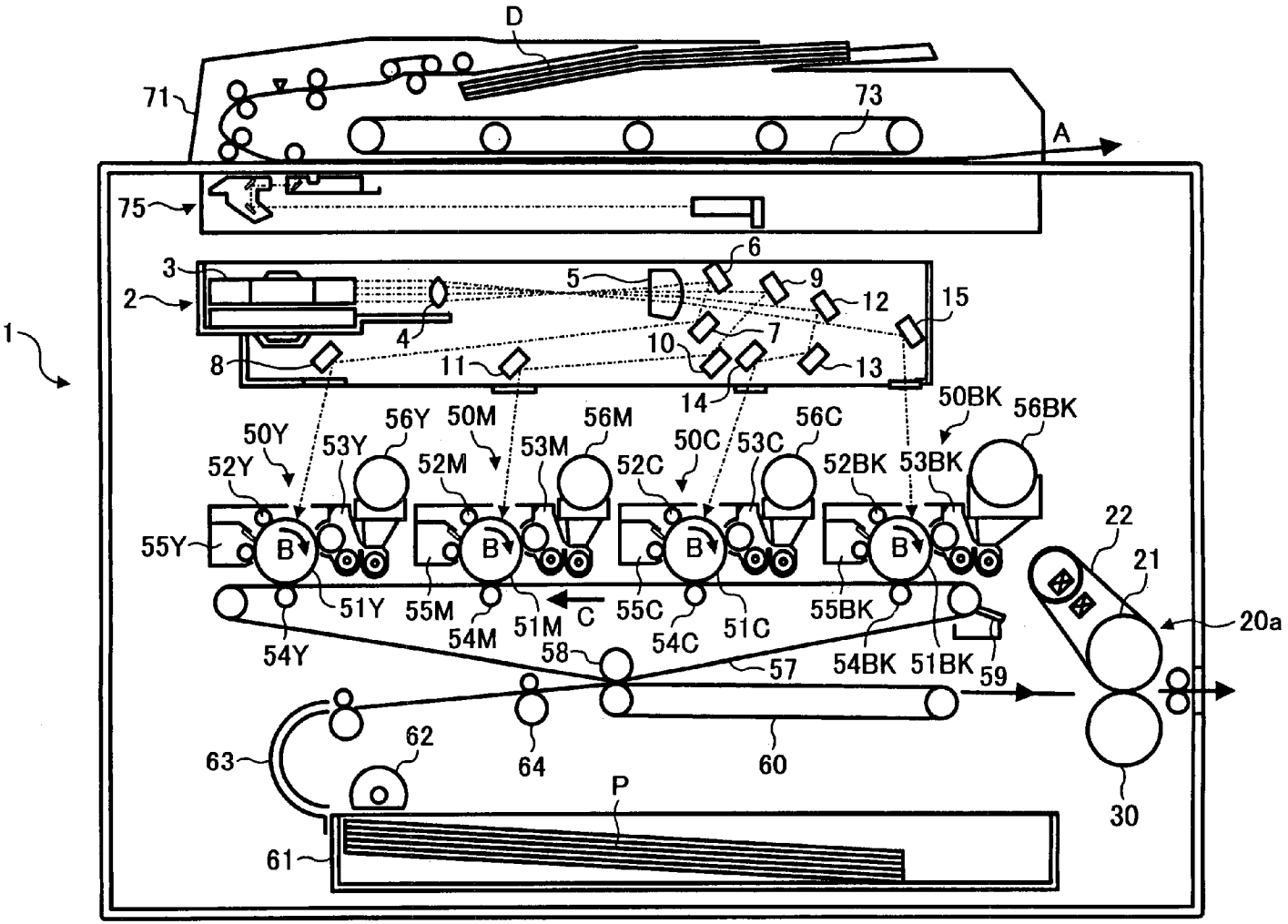
FIG. 1 is an illustration of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to an exemplary embodiment of the present invention is explained.

As illustrated in FIG. 1, an image forming apparatus 1 includes a document feeder 71, a reader 75, an exposure unit 2, process cartridges 50Y, 50M, 50C, and 50BK, toner replenishers 56Y, 56M, 56C, and 56BK, transfer bias rollers 54Y, 54M, 54C, and 54BK, an intermediate transfer belt 57, a paper tray 61, a feeding roller 62, a guide 63, a roller 64, a transfer bias roller 58, an intermediate transfer belt cleaner 59, a transfer belt 60, and a fixing unit 20*a*.

The reader 75 includes an exposure glass 73.

The exposure unit 2 includes a polygon mirror 3, lenses 4 and 5, and mirrors 6 to 15.

The process cartridge 50Y includes a photoconductive drum 51Y, a charger 52Y, a development unit 53Y, and a cleaner 55Y. The process cartridge 50M includes a photoconductive drum 51M, a charger 52M, a development unit 53M, and a cleaner 55M. The process cartridge 50C includes a photoconductive drum 51C, a charger 52C, a development unit 53C, and a cleaner 55C. The process cartridge 50BK includes a photoconductive drum 51BK, a charger 52BK, a development unit 53BK, and a cleaner 55BK.

The fixing unit 20*a* includes an auxiliary fixing roller 21, a fixing belt 22, and a pressure roller 30.

The image forming apparatus 1 is configured to function for example as a color copier. The document feeder 71 is configured to feed an original D to the reader 75. The reader 75 is configured to scan an image on the original D.

The exposure glass 73 is configured to form a glass on which the original D is placed and through which the image on the original D is optically scanned. The exposure unit 2 is configured to irradiate a laser beam onto each of the photoconductive drums 51Y, 51M, 51C, and 51BK based on image information obtained from the scanned original D. The polygon mirror 3 is configured to reflect the laser beams corresponding to yellow, magenta, cyan, and black colors to the lens 4. The lenses 4 and 5 are configured to form lenses through which the reflected laser beams are transmitted. The mirrors 6 to 8 are configured to reflect the transmitted laser beam corresponding to the yellow color to the photoconductive drum 51Y to form an electrostatic latent image corresponding to the yellow color on the photoconductive drum 51Y. The mirrors 9 to 11 are configured to reflect the transmitted laser beam corresponding to the magenta color to the photoconductive drum 51M to form an electrostatic latent image corresponding to the magenta color on the photoconductive drum 51M. The mirrors 12 to 14 are configured to reflect the transmitted laser beam corresponding to the cyan color to the photoconductive drum 51C to form an electrostatic latent image corresponding to the cyan color on the photoconductive drum 51C. The mirror 15 is configured to reflect the transmitted laser beam corresponding to the black color to the photoconductive drum 51BK to form an electrostatic latent image corresponding to the black color on the photoconductive drum 51BK.

The process cartridges 50Y, 50M, 50C, and 50BK are configured to be attachable and detachable to and from the image forming apparatus 1.

The charger 52Y is configured to charge a surface of the photoconductive drum 51Y. The charger 52M is configured to charge a surface of the photoconductive drum 51M. The charger 52C is configured to charge a surface of the photoconductive drum 51C. The charger 52BK is configured to charge a surface of the photoconductive drum 51BK. The photoconductive drum 51Y is configured to carry the electrostatic latent image corresponding to the yellow color. The photoconductive drum 51M is configured to carry the electrostatic latent image corresponding to the magenta color. The photoconductive drum 51C is configured to carry the electrostatic latent image corresponding to the cyan color. The photoconductive drum 51BK is configured to carry the electrostatic latent image corresponding to the black color. The development unit 53Y is configured to visualize with yellow-color toner the electrostatic latent image corresponding to the yellow color to form a yellow-color toner image. The development unit 53M is configured to visualize with magenta-color toner the electrostatic latent image corresponding to the magenta color to form a magenta-color toner image. The development unit 53C is configured to visualize with cyan-color toner the electrostatic latent image corresponding to the cyan color to form a cyan-color toner image. The development unit 53BK is configured to visualize with black-color toner the electrostatic latent image corresponding to the black color to form a black-color toner image. The toner replenisher 56Y is configured to replenish the development unit 53Y with the yellow-color toner. The toner replenisher 56M is configured to replenish the development unit 53M with the magenta-color toner. The toner replenisher 56C is configured to replenish the development unit 53C with the cyan-color toner. The toner replenisher 56BK is configured to replenish the development unit 53BK with the black-color toner.

The transfer bias roller 54Y is configured to transfer the yellow-color toner image formed on the photoconductive drum 51Y onto the intermediate transfer belt 57. The transfer bias roller 54M is configured to transfer the magenta-color toner image formed on the photoconductive drum 51M onto the intermediate transfer belt 57. The transfer bias roller 54C is configured to transfer the cyan-color toner image formed on the photoconductive drum 51C onto the intermediate transfer belt 57. The transfer bias roller 54BK is configured to transfer the black-color toner image formed on the photoconductive drum 51BK onto the intermediate transfer belt 57.

The cleaner 55Y is configured to remove the yellow-color toner not transferred and remaining on the photoconductive drum 51Y. The cleaner 55M is configured to remove the magenta-color toner not transferred and remaining on the photoconductive drum 51M. The cleaner 55C is configured to remove the cyan-color toner not transferred and remaining on the photoconductive drum 51C. The cleaner 55BK is configured to remove the black-color toner not transferred and remaining on the photoconductive drum 51BK.

The intermediate transfer belt 57 is configured to form an endless belt onto which the toner images in the yellow, magenta, cyan, and black colors are transferred and superimposed to form a full-color toner image. The paper tray 61 is configured to load recording sheets P. The feeding roller 62 is configured to feed the recording sheet P from the paper tray 61 to the guide 63. The guide 63 is configured to guide the recording sheet P to the roller 64. The roller 64 is configured to feed the recording sheet P to the transfer bias roller 58. The transfer bias roller 58 is configured to transfer the full-color toner image formed on the intermediate transfer belt 57 onto the recording sheet P. The intermediate transfer belt cleaner 59 is configured to remove the toner not transferred and remaining on the intermediate transfer belt 57. The transfer belt 60 is configured to convey the recording sheet P having the full-color toner image to the fixing unit 20*a*.

The process cartridges 50Y, 50M, 50C, and 50BK, the transfer bias rollers 54Y, 54M, 54C, and 54BK, the intermediate transfer belt 57, the transfer bias roller 58, and the transfer belt 60 form an image forming unit.

The fixing unit 20*a* is configured to fix the full-color toner image on the recording sheet P. The fixing belt 22 is configured to apply heat to the recording sheet P to fix the full-color toner image on the recording sheet P. The pressure roller 30 is configured to apply pressure to the recording sheet P to fix the full-color toner image on the recording sheet P. The auxiliary fixing roller 21 is configured to receive the pressure from the pressure roller 30 via the recording sheet P and the fixing belt 22.

Operations for forming a full-color toner image on the recording sheet P are explained below. The original D placed on the document feeder 71 is fed in a direction A onto the exposure glass 73. The reader 75 scans an image on the original D by irradiating a light onto the original D. The original D reflects the light. The reflected light is further reflected by mirrors (not shown) and transmitted through a lens (not shown) to form the image in a color sensor (not shown). The color sensor reads color information of the image as RGB (i.e., red, green, and blue colors) image data. The RGB image data is processed into RGB image signals. An image processor (not shown) performs color conversion based on strengths of the RGB image signals to convert the RGB image signals into YMCK (i.e., yellow, magenta, cyan, and black colors) image signals. The YMCK image signals are sent to the exposure unit 2.

Each of the photoconductive drums 51Y, 51M, 51C, and 51BK rotates in a rotating direction B. Each of the chargers 52Y, 52M, 52C, and 52BK uniformly charges a portion on each surface of the photoconductive drums 51Y, 51M, 51C, and 51BK. The portion is charged at a position where each of the chargers 52Y, 52M, 52C, and 52BK faces each of the photoconductive drums 51Y, 51M, 51C, and 51BK. Thus, an electric potential is formed on each surface of the photoconductive drums 51Y, 51M, 51C, and 51BK. The charged portion on each surface of the photoconductive drums 51Y, 51M, 51C, and 51BK reaches a position where each of the photoconductive drums 51Y, 51M, 51C, and 51BK receives a laser beam. In the exposure unit 2, a light source (not shown) irradiates laser beams based on the YMCK image signals. The polygon mirror 3 reflects the laser beams. The reflected laser beams are transmitted through the lenses 4 and 5. The transmitted laser beams travel through different paths which vary depending on the color (i.e., the yellow, magenta, cyan, or black color).

The laser beam corresponding to the yellow color is reflected by the mirrors 6 to 8, and then irradiated onto the surface of the photoconductive drum 51Y. The polygon mirror 3 rotating at a high speed causes the laser beam to scan in an axial direction (i.e., a main scanning direction) of the photoconductive drum 51Y. Thus, an electrostatic latent image corresponding to the yellow color is formed on the charged photoconductive drum 51Y.

The laser beam corresponding to the magenta color is reflected by the mirrors 9 to 11, and then irradiated onto the surface of the photoconductive drum 51M. Thus, an electrostatic latent image corresponding to the magenta color is formed on the charged photoconductive drum 51M. The laser beam corresponding to the cyan color is reflected by the mirrors 12 to 14, and then irradiated onto the surface of the photoconductive drum 51C. Thus, an electrostatic latent image corresponding to the cyan color is formed on the charged photoconductive drum 51C. The laser beam corresponding to the black color is reflected by the mirror 15, and then irradiated onto the surface of the photoconductive drum 51BK. Thus, an electrostatic latent image corresponding to the black color is formed on the charged photoconductive drum 51BK.

The portion on each surface of the photoconductive drums 51Y, 51M, 51C, and 51BK having the electrostatic latent image reaches a position where the portion faces each of the development units 53Y, 53M, 53C, and 53BK. Each of the development units 53Y, 53M, 53C, and 53BK visualizes the electrostatic latent image with toner in each of the yellow, magenta, cyan, and black colors to form a toner image in each of the yellow, magenta, cyan, and black colors.

The portion on each surface of the photoconductive drums 51Y, 51M, 51C, and 51BK having the toner image in each of the yellow, magenta, cyan, and black colors reaches a position (i.e., a first transfer position) where the portion faces the intermediate transfer belt 57. Each of the transfer bias rollers 54Y, 54M, 54C, and 54BK is disposed to contact an inner circumferential surface of the intermediate transfer belt 57 at the first transfer position. The toner image in each of the yellow, magenta, cyan, and black colors formed on each surface of the photoconductive drums 51Y, 51M, 51C, and 51BK is transferred and superimposed onto the intermediate transfer belt 57 at the first transfer position to form a full-color toner image.

The portion on each surface of the photoconductive drums 51Y, 51M, 51C, and 51BK reaches a position where the portion faces each of the cleaners 55Y, 55M, 55C, and 55BK. Each of the cleaners 55Y, 55M, 55C, and 55BK removes the toner in each of the yellow, magenta, cyan, and black colors not transferred and remaining on each of the photoconductive drums 51Y, 51M, 51C, and 51BK.

The portion on each surface of the photoconductive drums 51Y, 51M, 51C, and 51BK passes under a discharger (not shown).

The intermediate transfer belt 57 rotates in a rotating direction C. A portion on a surface of the intermediate transfer belt 57 where the toner image in each of the yellow, magenta, cyan, and black colors formed on each of the photoconductive drums 51Y, 51M, 51C, and 51BK is transferred and superimposed reaches a position (i.e., a second transfer position) where the transfer bias roller 58 contacts the inner circumferential surface of the intermediate transfer belt 57. The full-color toner image formed on the intermediate transfer belt 57 is transferred onto the recording sheet P at the second transfer position.

The portion on the surface of the intermediate transfer belt 57 reaches a position where the intermediate transfer belt cleaner 59 faces the intermediate transfer belt 57. The intermediate transfer belt cleaner 59 removes the toner not transferred and remaining on the intermediate transfer belt 57.

The recording sheet P is fed by the feeding roller 62 from the paper tray 61. The recording sheet P is conveyed through the guide 63 to the roller 64. The recording sheet P is further conveyed to the transfer bias roller 58 at a timing when the full-color toner image formed on the intermediate transfer belt 57 is properly transferred onto the recording sheet P.

The recording sheet P having the full-color toner image is conveyed by the transfer belt 60 to the fixing unit 20*a*. The recording sheet P is inserted between the fixing belt 22 and the pressure roller 30. The fixing belt 22 applies heat to the recording sheet P. The pressure roller 30 applies pressure to the recording sheet P. The heat and pressure fix the full-color toner image on the recording sheet P. The recording sheet P having the fixed full-color toner image separates from the fixing belt 22, and then is output from the image forming apparatus 1.

Figure 2:
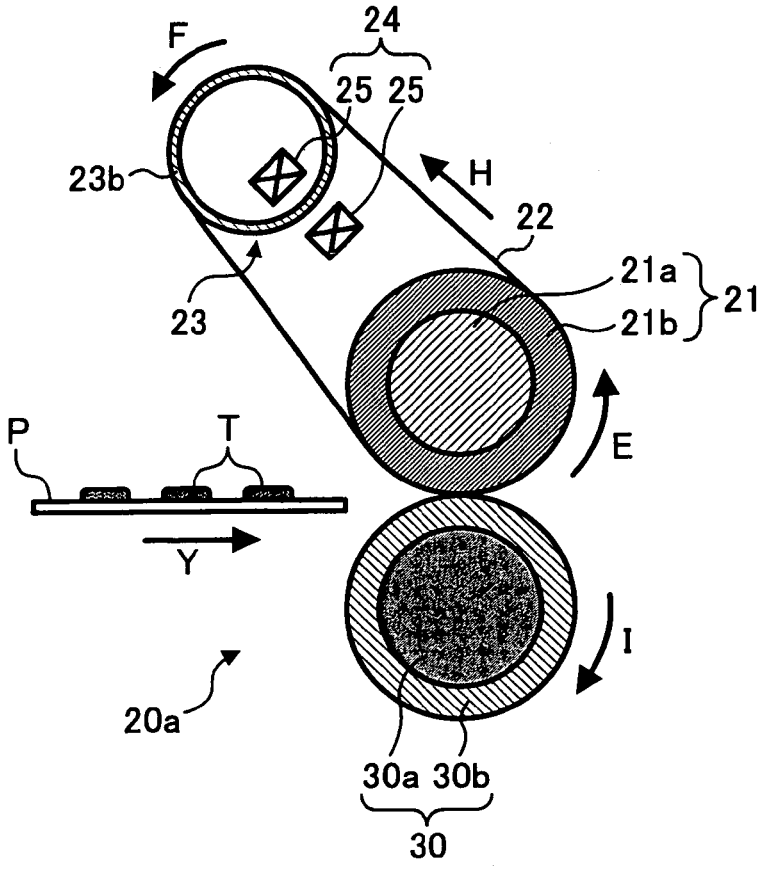
FIG. 2 is a cross-sectional view of a fixing unit of the image forming apparatus shown in FIG. 1.

As illustrated in FIG. 2, the fixing unit 20*a* further includes a support roller 23 and an induction heater 24.

The auxiliary fixing roller 21 includes a core 21*a* and an elastic layer 21*b*. The support roller 23 includes a heating layer 23*b*. The induction heater 24 includes a magnetic flux generator 25. The pressure roller 30 includes a core 30*a* and an elastic layer 30*b*.

The support roller 23 is configured to support and heat the fixing belt 22. The induction heater 24 is configured to generate a magnetic field. The magnetic flux generator 25 is configured to generate a magnetic flux. The heating layer 23*b* is configured to generate heat by the magnetic flux generated by the magnetic flux generator 25. The core 21*a* is configured to be formed under the elastic layer 21*b*. The elastic layer 21*b* is configured to be formed on a surface of the core 21*a*. The core 30*a* is configured to be formed under the elastic layer 30*b*. The elastic layer 30*b* is configured to be formed on a surface of the core 30*a*.

According to the present embodiment, the fixing belt 22 functions as a fixing member for fixing a toner image T on the recording sheet P. The support roller 23 functions as a heater for heating the fixing member.

The core 21*a* includes stainless steel. The elastic layer 21*b* includes silicone rubber. The elastic layer 21*b* has a thickness of 3 mm to 10 mm and an asker hardness of 10 to 50 degrees. A driver (not shown) drives and rotates the auxiliary fixing roller 21 in a rotating direction E.

The heating layer 23*b* is formed in a cylindrical shape and includes a magnetic, conductive material. The magnetic, conductive material includes any one of nickel, steel, chrome, and an alloy of those. The heating layer 23*b* has a thickness of approximately 0.6 mm. The support roller 23 rotates in a rotating direction F. The magnetic flux generator 25 is disposed at a position facing an outer circumferential surface (i.e., a front surface) and an inner circumferential surface (i.e., a back surface) of the support roller 23.

According to the present embodiment, the support roller 23 includes a magnetic shunt alloy having a Curie point not lower than a fixing temperature and not greater than 300 degrees centigrade. Specifically, the magnetic shunt alloy includes an alloy of nickel, steel, and chrome. The preferred Curie point can be obtained by adjusting a quantity of the materials and the processing conditions. The support roller 23 includes the magnetic, conductive material in which the Curie point is near the fixing temperature. Thus, the support roller 23 is properly heated and not overheated.

According to the present embodiment, the support roller 23 includes only the heating layer 23*b*. However, the support roller 23 may include a reinforcing layer (not shown), an elastic layer (not shown), and an insulating layer (not shown) on the heating layer 23*b*.

The core 30*a* includes any one of aluminum and copper. The elastic layer 30*b* includes any one of fluorocarbon rubber and silicone rubber. The elastic layer 30*b* has a thickness of 1 mm to 5 mm and an asker hardness of 20 to 50 degrees. The pressure roller 30 presses the auxiliary fixing roller 21 via the fixing belt 22. The recording sheet P is conveyed to a contact position (i.e., a fixing nip) where the pressure roller 30 contacts the fixing belt 22.

A thermistor (not shown) contacts an outer circumferential surface of the fixing belt 22 at an upstream side of the contact position. The thermistor includes a temperature-sensitive element having an increased thermal response. The thermistor detects a surface temperature of the fixing belt 22 to adjust an output of the magnetic flux from the magnetic flux generator 25.

The fixing belt 22 is laid across the support roller 23 and the auxiliary fixing roller 21 in a tensioned condition that the support roller 23 and the auxiliary fixing roller 21 support the fixing belt 22.

Figure 3:
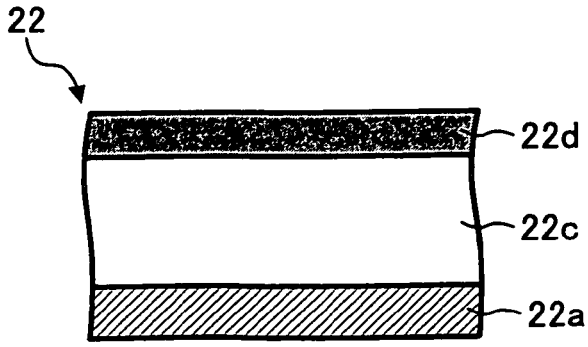
FIG. 3 is a cross-sectional view of a fixing belt of the fixing unit shown in FIG. 2.

As illustrated in FIG. 3, the fixing belt 22 includes a multi-layered, endless belt. The fixing belt 22 includes a base layer 22*a*, an elastic layer 22*c*, and a releasing layer 22*d*. The elastic layer 22*c* is formed on the base layer 22*a*. The releasing layer 22*d* is formed on the elastic layer 22*c*.

The base layer 22*a* includes an insulative heat-resistant resin material. The insulative heat-resistant resin material includes any one of a polyimide resin, a polyamide-imide resin, a PEEK (polyetheretherketone) resin, a PES (polyethersulfone) resin, a PPS (polyphenylene sulfide) resin, and a fluorocarbon resin, for example. The base layer 22*a* has a thickness of 30 μm to 200 μm, considering heat capacity and strength.

The elastic layer 22*c* includes any one of silicone rubber and fluoro-silicone rubber. The elastic layer 22*c* has a thickness of 50 μm to 500 μm and an asker hardness of 5 to 50 degrees. Thus, the toner image transferred on the recording sheet P can be uniformly glossy.

The releasing layer 22*d* includes any one of a fluorocarbon resin, a mixture of the fluorocarbon resins, and a heat-resistant resin in which the fluorocarbon resins are dispersed. The fluorocarbon resin includes any one of a PTFE (polytetrafluoroethylene) resin, a PFA (tetrafluoroethylene-perfluoroalkylvinylether) copolymer resin, and an FEP (tetrafluoroethylene-hexafluoropropylene) copolymer resin. The releasing layer 22*d* has a thickness of 5 μm to 50 μm, preferably 10 μm to 30 μm. Thus, the toner may be easily released from the fixing belt 22, and the fixing belt 22 may have flexibility.

Figure 4:
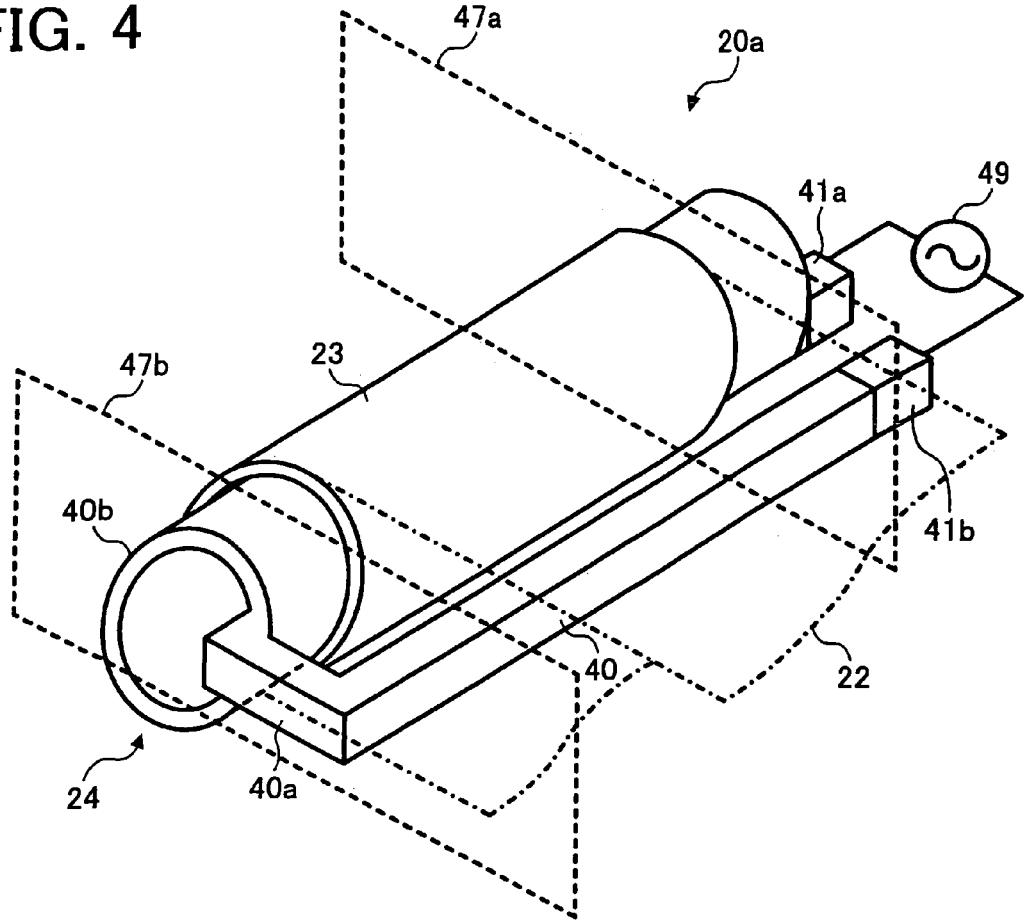
FIG. 4 is a perspective view of an induction heater and a high-frequency power source of the fixing unit shown in FIG. 2.

As illustrated in FIG. 4, the fixing unit 20*a* further includes side plates 47*a* and 47*b* and a high-frequency power source 49. The induction heater 24 further includes a holder 40, and connectors 41*a* and 41*b*. The holder 40 includes a first holder 40*a* and a second holder 40*b*.

The side plates 47*a* and 47*b* are configured to support the holder 40. The holder 40 is configured to hold the magnetic flux generator 25 and the support roller 23. The first holder 40*a* is configured to hold the magnetic flux generator 25. The second holder 40*b* is configured to hold the support roller 23. The connectors 41*a* and 41*b* are configured to connect the magnetic flux generator 25 with the high-frequency power source 49. The high-frequency power source 49 is configured to apply an alternating current to the magnetic flux generator 25.

The first holder 40*a* and the second holder 40*b* are integrated. The second holder 40*b* contacts the inner circumferential surface of the support roller 23. The second holder 40*b* rotatably holds the support roller 23. Thus, the support roller 23 is positioned against the magnetic flux generator 25.

The holder 40 includes a heat-resistant, non-magnetic material. The heat-resistant, non-magnetic material includes any one of a polyimide resin, a polyamide resin, a polyamide-imide resin, a PEEK resin, a PES resin, a PPS resin, a PBI (polybenzimidazole) resin, and ceramic. Thus, the holder 40 can hold the magnetic flux generator 25 and the support roller 23 without decreasing the heating efficiency of the magnetic flux generated by the magnetic flux generator 25.

A low friction material is coated or applied on an outer circumferential surface (i.e., a sliding surface facing the inner circumferential surface of the support roller 23) of the second holder 40*b*. Specifically, a heat-resistant fluorocarbon resin is coated on the outer circumferential surface of the second holder 40*b*. Otherwise, fluorocarbon grease is applied on the outer circumferential surface of the second holder 40*b*. Thus, a decreased friction resistance is generated between the inner circumferential surface of the rotating support roller 23 and the outer circumferential surface of the second holder 40*b*.

The side plates 47*a* and 47*b* support the holder 40. The two side plates 47*a* and 47*b* are fixedly installed at both ends of the holder 40 in an axial direction of the support roller 23. Thus, the support roller 23 and the magnetic flux generator 25 are positioned in the fixing unit 20*a*.

The holder 40 holds the connectors 41*a* and 41*b*. The connectors 41*a* and 41*b* are respectively provided on a head and a tail of the magnetic flux generator 25. One end of the magnetic flux generator 25 in the axial direction of the support roller 23 forms a loopback portion. The loopback portion connects a portion of the magnetic flux generator 25 that faces the outer circumferential surface of the support roller 23 with a portion of the magnetic flux generator 25 that faces the inner circumferential surface of the support roller 23. The other end of the magnetic flux generator 25 in the axial direction of the support roller 23 is connected with the high-frequency power source 49 via the connectors 41*a* and 41*b*.

The high-frequency power source 49 is fixedly installed near the other end of the magnetic flux generator 25 in the axial direction of the support roller 23. The high-frequency power source 49 applies an alternating current to the magnetic flux generator 25. The alternating current has a frequency of 10 kHz to 1 MHz, preferably 10 kHz to 300 kHz.

Figure 5:
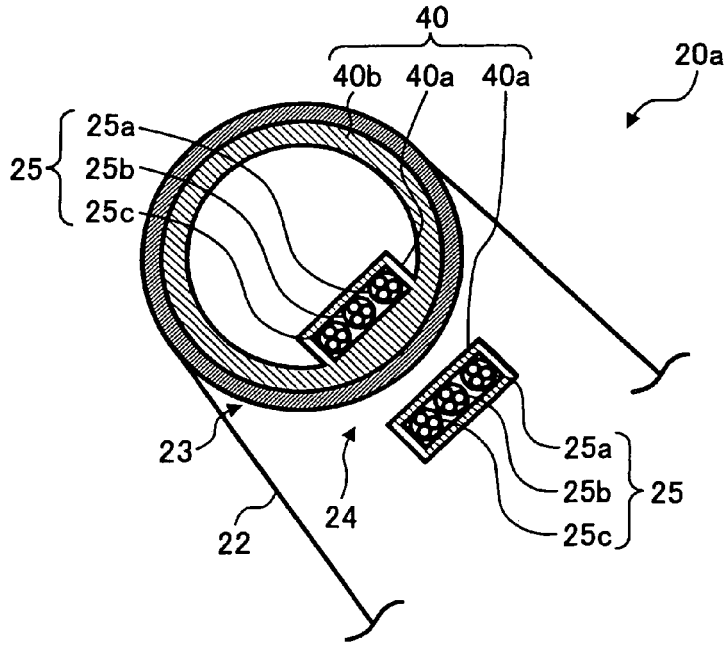
FIG. 5 is a cross-sectional view of the induction heater shown in FIG. 4.

As illustrated in FIG. 5, the magnetic flux generator 25 includes U-shaped members 25*a*, 25*b*, and 25*c*.

Each of the U-shaped members 25*a*, 25*b*, and 25*c* is configured to generate a magnetic flux.

The magnetic flux generator 25 includes an exciting coil facing the outer and inner circumferential surfaces of the support roller 23. The magnetic flux generator 25 is disposed in parallel to the axial direction of the support roller 23, and extends in the axial direction of the support roller 23. The magnetic flux generator 25 includes copper. Each of the U-shaped members 25*a*, 25*b*, and 25*c* is formed in a U-like shape and includes a plurality of single wires bunched, twisted, and insulated to each other.

The first holder 40*a* holds the U-shaped members 25*a*, 25*b*, and 25*c*. Specifically, the first holder 40*a* includes a hollow. The U-shaped members 25*a*, 25*b*, and 25*c* are aligned in the hollow.

Figure 6A:
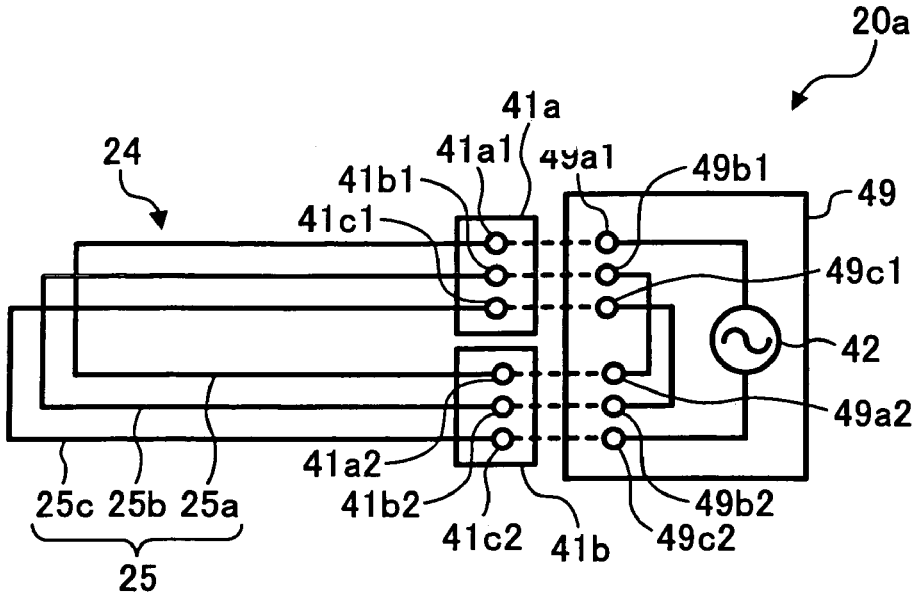
FIG. 6A is a schematic illustration illustrating an electrical connection between the induction heater and the high-frequency power source shown in FIG. 4.

As illustrated in FIG. 6A, the connector 41*a* includes terminals 41*a*1, 41*b*1, and 41*c*1. The connector 41*b* includes terminals 41*a*2, 41*b*2, and 41*c*2. The high-frequency power source 49 includes terminals 49*a*1, 49*b*1, 49*c*1, 49*a*2, 49*b*2, and 49*c*2, and an alternating-current power supply 42.

The connectors 41*a* and 41*b* are configured to connect the U-shaped members 25*a*, 25*b*, and 25*c* with the high-frequency power source 49. The terminal 41*a*1 is connected with the U-shaped member 25*a*. The terminal 41*b*1 is connected with the U-shaped member 25*b*. The terminal 41*c*1 is connected with the U-shaped member 25*c*. The terminal 41*a*2 is connected with the U-shaped member 25*a*. The terminal 41*b*2 is connected with the U-shaped member 25*b*. The terminal 41*c*2 is connected with the U-shaped member 25*c*. The alternating-current power supply 42 is configured to apply an alternating current to the magnetic flux generator 25.

Terminals provided in the head of the magnetic flux generator 25 and terminals provided in the tail of the magnetic flux generator 25 are separately provided in different connectors. Specifically, the terminals 41*a*1, 41*b*1, and 41*c*1 are provided in the connector 41*a*. The terminals 41*a*2, 41*b*2, and 41*c*2 are provided in the connector 41*b*.

The terminal 41*a*1 is connected to the terminal 49*a*1. The terminal 41*b*1 is connected to the terminal 49*b*1. The terminal 41*c*1 is connected to the terminal 49*c*1. The terminal 41*a*2 is connected to the terminal 49*a*2. The terminal 41*b*2 is connected to the terminal 49*b*2. The terminal 41*c*2 is connected to the terminal 49*c*2.

In the high-frequency power source 49, the terminal 49*b*1 is connected to the terminal 49*a*2. The terminal 49*c*1 is connected to the terminal 49*b*2. The terminals 49*a*1 and 49*c*2 are connected to the alternating-current power supply 42. Thus, an alternating current channel is formed in the magnetic flux generator 25. The alternating-current power supply 42 applies an alternating current through the alternating current channel to the U-shaped members 25*a*, 25*b*, and 25*c*. Thus, an alternating magnetic field can be effectively generated by the three U-shaped members 25*a*, 25*b*, and 25*c* by using the one alternating-current power supply 42.

According to the present embodiment, the holder 40 holds the two connectors 41*a* and 41*b*. However, the holder 40 may hold one connector.

Figure 6B:
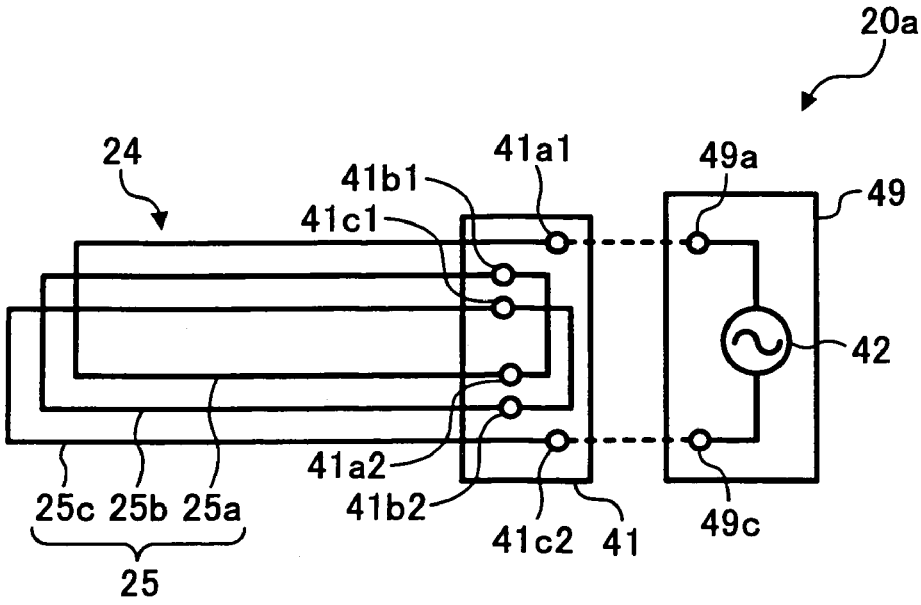
FIG. 6B is a schematic illustration illustrating another electrical connection between the induction heater and the high-frequency power source shown in FIG. 4.

As illustrated in FIG. 6B, the fixing unit 20*a* alternately includes a connector 41, a terminal 49*a*, and a terminal 49*c*. The connector 41 replaces the connectors 41*a* and 41*b*. The terminal 49*a* replaces the terminal 49*a*1. The terminal 49*c* replaces the terminal 49*c*2. The fixing unit 20*a* according to one embodiment does not include the terminals 49*b*1, 49*c*1, 49*a*2, and 49*b*2.

The connector 41 is configured to connect the U-shaped members 25*a*, 25*b*, and 25*c* with the high-frequency power source 49. The terminal 49*a* is connected with the U-shaped member 25*a*. The terminal 49*c* is connected with the U-shaped member 25*c*.

The terminals 41*a*1 and 41*c*2 function as input-output terminals. The terminal 41*a*1 is connected to the terminal 49*a*. The terminal 41*c*2 is connected to the terminal 49*c*. In the connector 41, the terminal 41*b*1 is connected to the terminal 41*a*2. The terminal 41*c*1 is connected to the terminal 41*b*2. The terminals 49*a* and 49*c* are connected to the alternating-current power supply 42. Thus, an alternating current channel is formed in the magnetic flux generator 25. The alternating-current power supply 42 applies an alternating current through the alternating current channel to the U-shaped members 25*a*, 25*b*, and 25*c*. Thus, an alternating magnetic field can be effectively generated by the three U-shaped members 25*a*, 25*b*, and 25*c* by using the one alternating-current power supply 42.

Referring to FIGS. 2 and 4, operations of a fixing process performed by the fixing unit 20*a* are explained below.

The auxiliary fixing roller 21 rotating in the rotating direction E drives and rotates the fixing belt 22 in a rotating direction H. The support roller 23 rotates in the rotating direction F. The pressure roller 30 rotates in a rotating direction I.

The high-frequency power source 49 applies a high-frequency alternating current of 10 kHz to 1 MHz to the magnetic flux generator 25. The magnetic flux generator 25 is formed in a U-like or loop-like shape. Magnetic lines of force are formed in a gap or a loop formed by the U-like or loop-like shape. Directions of the magnetic lines of force alternately switch in opposite directions to form an alternating magnetic field. When a temperature of the support roller 23 is not greater than a Curie point, an eddy current is generated on a surface of the support roller 23. An electric resistance of the support roller 23 generates the Joule heat. The Joule heat is transferred to the fixing belt 22.

The Joule heat is transferred from the support roller 23 to the fixing belt 22 at a position where the support roller 23 contacts the fixing belt 22. A heated portion of the fixing belt 22 passes under the thermistor. When the heated portion reaches the contact position, the heated portion heats and melts the toner image T on the recording sheet P conveyed in a direction Y.

Specifically, the toner image T is formed on the recording sheet P through exposure and development processes as described above. A guide board (not shown) guides the recording sheet P in the direction Y to the contact position. The recording sheet P is inserted between the fixing belt 22 and the pressure roller 30. The fixing belt 22 applies heat to the recording sheet P. The pressure roller 30 applies pressure to the recording sheet P. The heat and pressure fix the toner image T on the recording sheet P. The recording sheet P having the fixed toner image T is fed out of the contact position.

The portion of the fixing belt 22 contacts the support roller 23 again. Then, the operations described above are repeated to complete the fixing process.

When the temperature of the support roller 23 exceeds the Curie point, the support roller 23 generates less heat. Namely, the support roller 23 loses its magnetic property and the generation of the eddy current is suppressed. Thus, the generation of the Joule heat is suppressed to prevent the temperature of the support roller 23 from increasing excessively.

The support roller 23 controls its temperature more effectively when the magnetic flux generator 25 formed in the U-like shape faces the outer and inner circumferential surfaces of the support roller 23 according to one embodiment than when the magnetic flux generator 25 faces only the outer circumferential surface of the support roller 23.

Figure 7A:
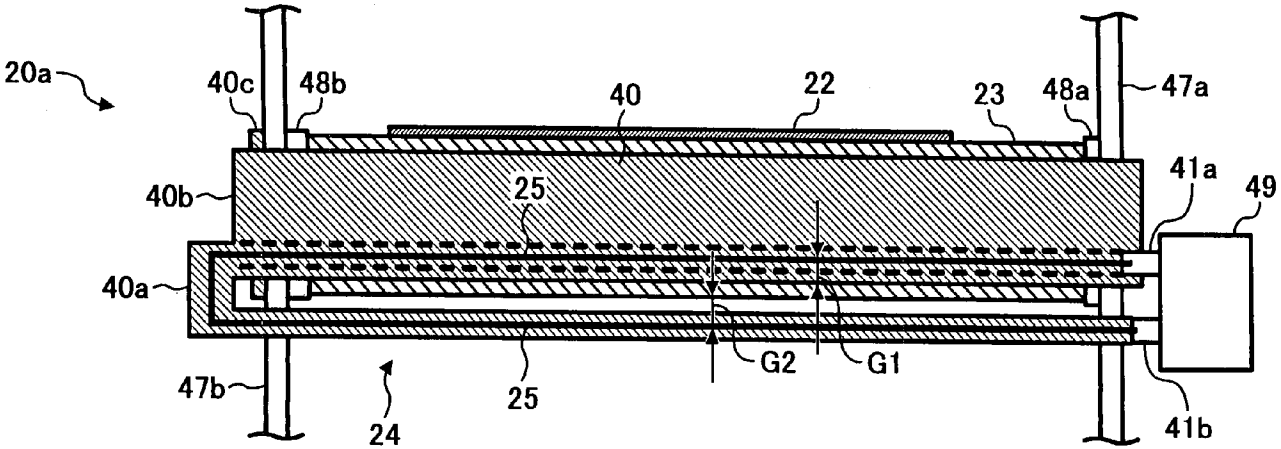
FIG. 7A is a cross-sectional view of the induction heater connected to the high-frequency power source shown in FIG. 4.
Figure 7B:
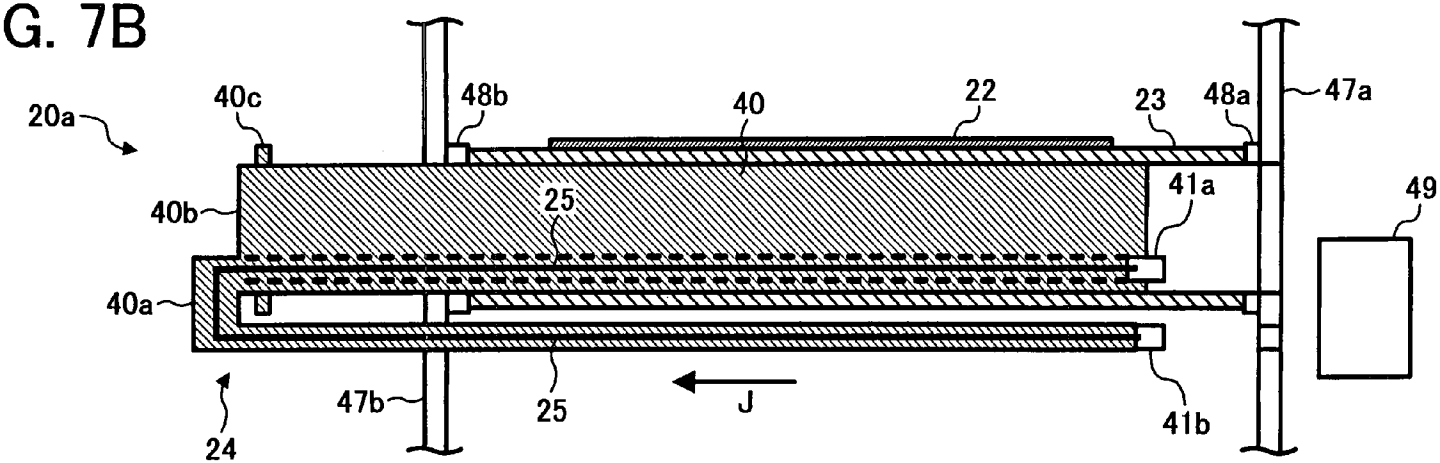
FIG. 7B is a cross-sectional view of the induction heater to be disconnected from the high-frequency power source shown in FIG. 7A.

As illustrated in FIGS. 7A and 7B, the fixing unit 20*a* further includes a stopper 40*c* and spacers 48*a* and 48*b*.

The stopper 40*c* is configured to position the induction heater 24 in the axial direction of the support roller 23. The spacers 48*a* and 48*b* are configured to position the support roller 23 in the axial direction of the support roller 23.

A gap G1 is provided between the inner circumferential surface of the support roller 23 and the magnetic flux generator 25 facing the inner circumferential surface of the support roller 23. A gap G2 is provided between the outer circumferential surface of the support roller 23 and the magnetic flux generator 25 facing the outer circumferential surface of the support roller 23. Lengths of the gaps G1 and G2 in a direction perpendicular to the axial direction of the support roller 23 are in a range of 0.5 mm to 50 mm.

FIG. 7A illustrates the induction heater 24 attached to the fixing unit 20*a*. The induction heater 24 is attachable and detachable to and from the fixing unit 20*a*. The induction heater 24 can be detached from the fixing unit 20*a* by moving the induction heater 24 in a direction J as illustrated in FIG. 7B.

The stopper 40*c* is provided at one end of the holder 40 in the axial direction of the support roller 23 and near the loop-back portion of the magnetic flux generator 25. The induction heater 24 is moved in a direction opposite to the direction J, so that the induction heater 24 is attached to the fixing unit 20*a*. When the stopper 40*c* contacts the side plate 47*b*, the induction heater 24 stops. Thus, the induction heater 24 is positioned in the axial direction of the support roller 23.

The spacer 48*a* is provided between the side plate 47*a* and the support roller 23 in the axial direction of the support roller 23. The spacer 48*b* is provided between the side plate 47*b* and the support roller 23 in the axial direction of the support roller 23. Thus, the support roller 23 is positioned in the axial direction of the support roller 23.

The induction heater 24 can be easily attached and detached to and from the fixing unit 20*a* for the maintenance of the fixing belt 22, which sometimes is frequently performed. Thus, the maintenance can be performed with an improved efficiency and the induction heater 24 can be easily and accurately installed. The fixing unit 20*a* according to the present embodiment is useful for a user who performs the maintenance.

As described above, according to the present embodiment, the magnetic flux generator 25 surrounds the support roller 23 in a state that the magnetic flux generator 25 faces the outer and inner circumferential surfaces of the support roller 23. The Curie point of the support roller 23 is set to be near the fixing temperature. Therefore, the support roller 23 effectively controls its temperature. Even when the toner image fixing is conducted a number of times in a consecutive manner relative to the smaller-size recording sheets P or the fixing unit 20*a* accidentally stops operating, it is possible to prevent the surface temperature of the fixing belt 22 from increasing excessively.

The magnetic flux generator 25 and the holder 40 can be integrated. The holder 40 holds the magnetic flux generator 25. The holder 40 positions the magnetic flux generator 25 against the support roller 23. Thus, an improved efficiency in heating the support roller 23 can be stably maintained. Installation and maintenance of the fixing unit 20*a* can be performed with improved efficiency.

According to one embodiment of the present invention, the magnetic flux generator 25 includes a plurality of U-shaped members (i.e., the U-shaped members 25*a*, 25*b*, and 25*c*). However, the magnetic flux generator 25 may include one U-shaped member. Each of the U-shaped members 25*a*, 25*b*, and 25*c* includes a plurality of single wires bunched, twisted, and insulated from each other. However, each of the U-shaped members 25*a*, 25*b*, and 25*c* may include a single wire. The single wire can be produced through a drawing process. In this case, effects similar to the effects according to the present embodiment can be obtained.

Figure 8:
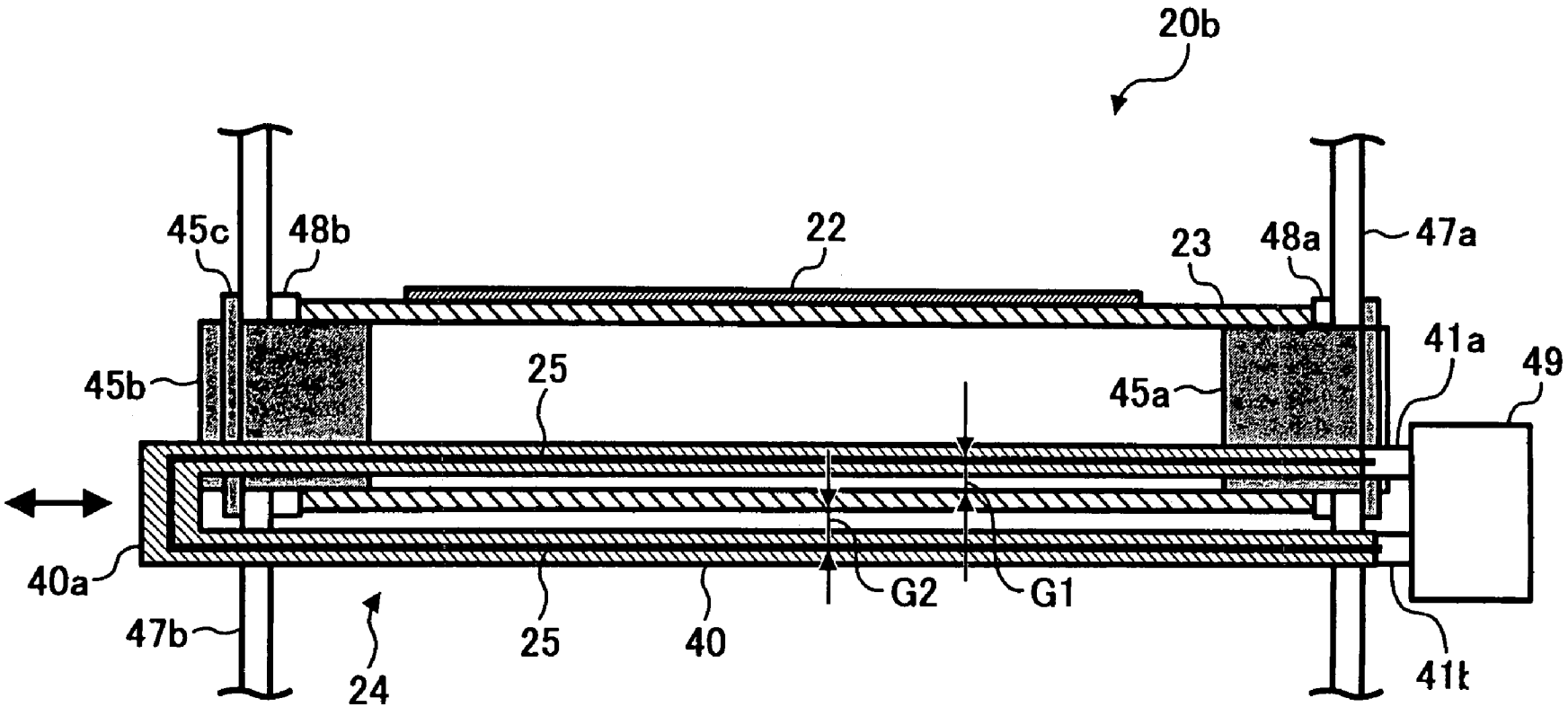
FIG. 8 is a cross-sectional view of an induction heater-of a fixing unit according to another exemplary embodiment of the present invention.

Referring to FIG. 8, another exemplary embodiment of the present invention is explained.

A fixing unit 20*b* includes parts included in the fixing unit 20*a*, but further includes bushes 45*a* and 45*b*, and a stopper 45*c*. The holder 40 does not include the second holder 40*b*.

The fixing unit 20*b* is configured to fix the toner image T on the recording sheet P. The bushes 45*a* and 45*b* are configured to position the support roller 23. The stopper 45*c* is configured to position the support roller 23 in the axial direction of the support roller 23.

The bushes 45*a* and 45*b* are inserted at both ends of the support roller 23 in the axial direction of the support roller 23. The side plate 47*a* supports the bush 45*a*. The side plate 47b supports the bush 45*b*. The side plates 47*a* and 47*b* rotatably support the support roller 23 via the bushes 45*a* and 45*b*. Thus, the support roller 23 is positioned in the direction perpendicular to the axial direction of the support roller 23. The support roller 23 is positioned in the axial direction of the support roller 23 by using the stopper 45*c* and the spacers 48*a* and 48*b*. A low friction material is coated or applied on an outer circumferential surface (i.e., a sliding surface facing the inner circumferential surface of the support roller 23) of each of the bushes 45*a* and 45*b*.

One end (i.e., a head) of the first holder 40*a* formed in a U-like shape facing the inner circumferential surface of the support roller 23 is inserted in a hole provided in the bush 45*a*. The other end (i.e., a tail) of the first holder 40*a* facing the outer circumferential surface of the support roller 23 is inserted in a hole provided in the side plate 47*a*. Thus, the bush 45*a* and the side plate 47*a* position the holder 40 against the support roller 23. Specifically, the gaps G1 and G2 are secured with high accuracy.

The holder 40 holds the connectors 41*a* and 41*b*. The connectors 41*a* and 41*b* are respectively provided on the head and the tail of the magnetic flux generator 25. The connectors 41*a* and 41*b* connect the magnetic flux generator 25 with the high-frequency power source 49. The high-frequency power source 49 is fixedly installed near one end of the support roller 23 in the axial direction of the support roller 23, that is, the end near which the connectors 41*a* and 41*b* are disposed. Thus, the high-frequency power source 49 can apply an alternating current to the magnetic flux generator 25.

The induction heater 24 is attachable and detachable to and from the fixing unit 20*b* through one end of the fixing unit 20*b* in the axial direction of the support roller 23. After the induction heater 24 is detached, the fixing unit 20*b* includes the support roller 23, the bushes 45*a* and 45*b*, the fixing belt 22, the auxiliary fixing roller 21, and the pressure roller 30.

As described above, according to one embodiment, the magnetic flux generator 25 surrounds the support roller 23 in a state that the magnetic flux generator 25 faces the outer and inner circumferential surfaces of the support roller 23. The Curie point of the support roller 23 is set to be near the fixing temperature. Therefore, the support roller 23 effectively controls its temperature. Even when the toner image fixing is performed a number of times in a consecutive manner relative to the smaller-size recording sheets P or the fixing unit 20*b* accidentally stops operating, the fixing unit 20*b* prevents the surface temperature of the fixing belt 22 from increasing excessively.

The magnetic flux generator 25 and the holder 40 can be integrated. The holder 40 holds the magnetic flux generator 25. The holder 40 positions the magnetic flux generator 25 against the support roller 23. Thus, an improved efficiency in heating the support roller 23 can be stably maintained. Installation and maintenance of the fixing unit 20*b* can be performed with improved efficiency.

Figure 9A:
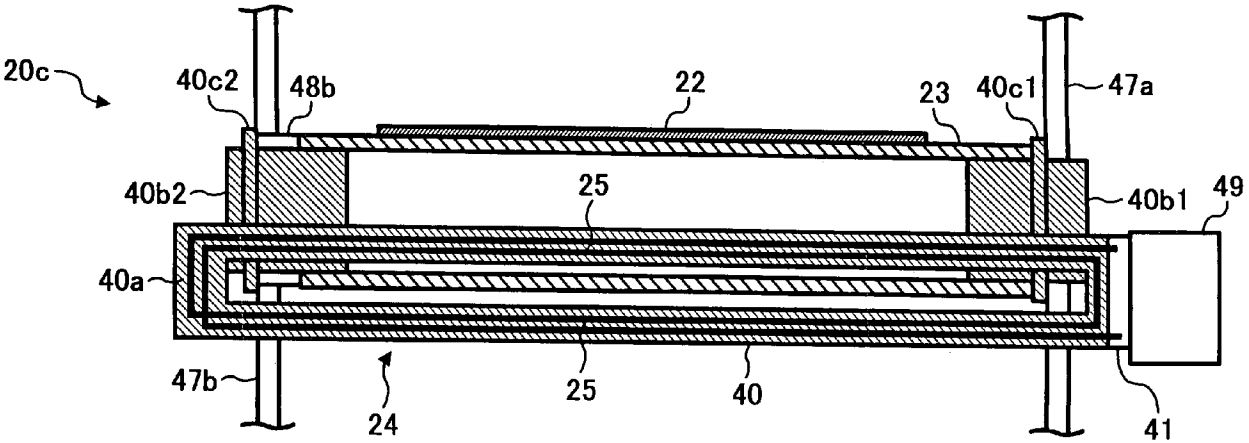
FIG. 9A is a cross-sectional view of an induction heater connected to a high-frequency power source according to another exemplary embodiment of the present invention.
Figure 9B:
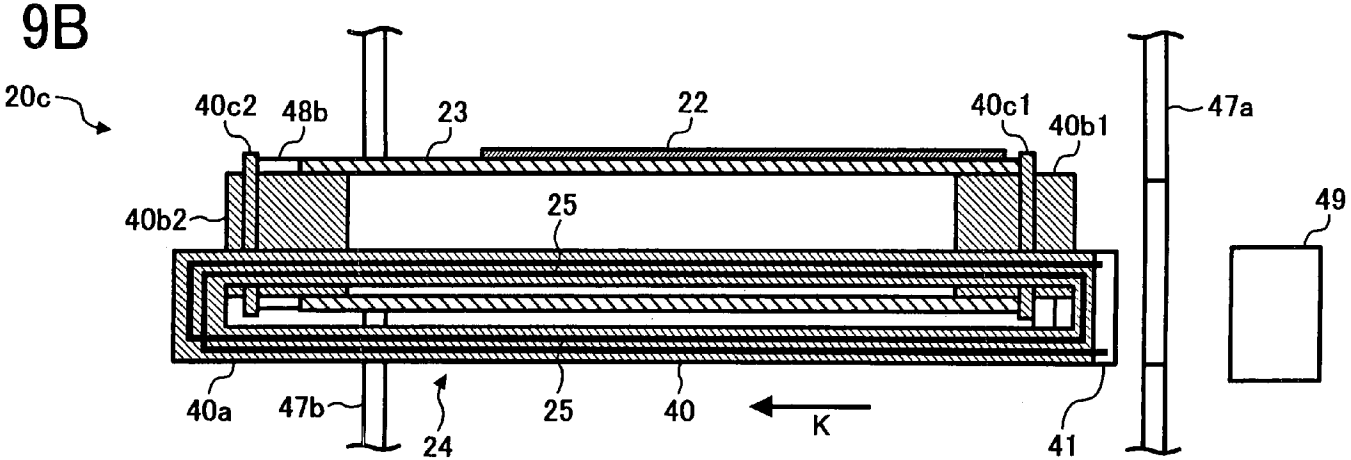
FIG. 9B is a cross-sectional view of the induction heater to be disconnected from the high-frequency power source shown in FIG. 9A.

Referring to FIGS. 9A and 9B, another exemplary embodiment of the present invention is explained.

A fixing unit 20*c* includes parts included in the fixing unit 20*a*, but further includes second holders 40*b*1 and 40*b*2, stoppers 40*c*1 and 40*c*2, and the connector 41. The fixing unit 20*c* does not include the second holder 40*b*, the stopper 40*c*, the connectors 41*a* and 41*b*, and the spacer 48*a*.

The fixing unit 20*c* is configured to fix the toner image T on the recording sheet P. The second holders 40*b*1 and 40*b*2 are configured to hold the support roller 23. The stoppers 40*c*1 and 40*c*2 are configured to position the induction heater 24 in the axial direction of the support roller 23.

The first holder 40*a* holds the magnetic flux generator 25. The first holder 40*a* includes a circle-like hollow. In the hollow, the magnetic flux generator 25 winds around the outer and inner circumferential surfaces of the support roller 23 a plurality of times.

The first holder 40*a* and the second holders 40*b*1 and 40*b*2 can be integrated. The second holders 40*b*1 and 40*b*2 contact the inner circumferential surface of the support roller 23 and function as bushes for the support roller 23.

The induction heater 24 and the support roller 23 are attachable and detachable to and from the fixing unit 20*c* through one end of the fixing unit 20*c* in the axial direction of the support roller 23. The induction heater 24 is moved in a direction K, so that the induction heater 24 and the support roller 23 are detached from the fixing unit 20*c*.

The stoppers 40*c*1 and 40*c*2 are provided on both ends of the holder 40 in the axial direction of the support roller 23. The induction heater 24 and the support roller 23 are moved in a direction opposite to the direction K, so that the induction heater 24 and the support roller 23 are attached to the fixing unit 20*c*. When the stoppers 40*c*1 and 40*c*2 respectively contact the side plates 47*a* and 47*b*, the induction heater 24 and the support roller 23 stop. Thus, the induction heater 24 and the support roller 23 are accurately positioned in the axial direction of the support roller 23.

When the induction heater 24 and the support roller 23 are attached, the connector 41 connects the induction heater 24 with the high-frequency power source 49. Thus, the high-frequency power source 49 can apply an alternating current to the magnetic flux generator 25.

The induction heater 24 and the support roller 23 are attachable and detachable to and from the fixing unit 20*c* through one end of the fixing unit 20*c* in the axial direction of the support roller 23. After the induction heater 24 and the support roller 23 are detached, the fixing unit 20*c* includes the fixing belt 22, the auxiliary fixing roller 21, and the pressure roller 30.

As described above, according to one embodiment, the magnetic flux generator 25 surrounds the support roller 23 in a state that the magnetic flux generator 25 faces the outer and inner circumferential surfaces of the support roller 23. The Curie point of the support roller 23 is set to be near the fixing temperature. Therefore, the support roller 23 effectively controls its temperature. Even when the toner image fixing is performed a number of times in a consecutive manner relative to the smaller-size recording sheets P or the fixing unit 20*c* accidentally stops operating, the fixing unit 20*c* prevents the surface temperature of the fixing belt 22 from increasing excessively.

The magnetic flux generator 25, the holder 40, and the support roller 23 can be integrated. Thus, an improved efficiency in heating the support roller 23 can be stably maintained. Installation and maintenance of the fixing unit 20*c* can be performed with improved efficiency.

Referring to FIGS. 10, 11A, 11B, 11C, and 11D, another exemplary embodiment of the present invention is explained.

A fixing unit 20*d* includes parts included in the fixing unit 20*a*, but further includes a heating layer 22*b*.

The fixing unit 20*d* is configured to fix the toner image T on the recording sheet P. The heating layer 22*b* is configured to generate heat by the magnetic flux generated by the magnetic flux generator 25.

Figure 10:
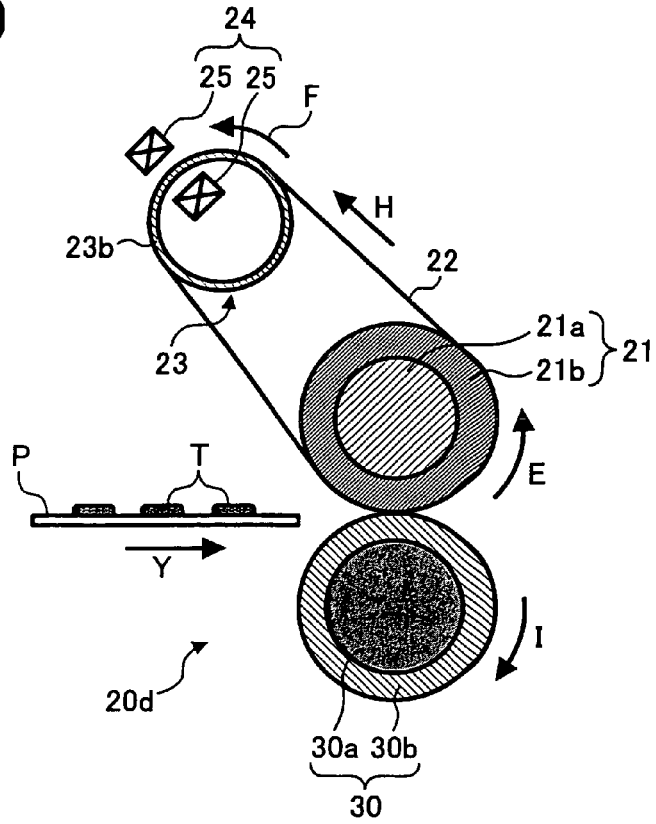
FIG. 10 is a cross-sectional view of a fixing unit according to another exemplary embodiment of the present invention.

As illustrated in FIG. 10, the magnetic flux generator 25 faces the outer circumferential surface of the support roller 23 via the fixing belt 22 and the inner circumferential surface of the support roller 23. The magnetic flux generator 25 is disposed substantially parallel to the axial direction of the support roller 23, and extends in the axial direction of the support roller 23. The induction heater 24 is attachable and detachable to and from the fixing unit 20*d*.

Figure 11A:
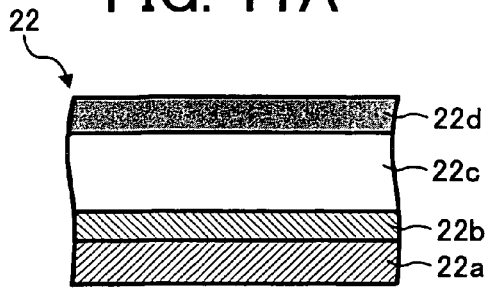
FIG. 11A is a cross-sectional view of a fixing belt of the fixing unit shown in FIG. 10.

As illustrated in FIG. 11A, the fixing belt 22 includes a multi-layered, endless belt. The fixing belt 22 includes the base layer 22*a*, the heating layer 22*b*, the elastic layer 22*c*, and the releasing layer 22*d*. The heating layer 22*b* is formed on the base layer 22*a*. The elastic layer 22*c* is formed on the heating layer 22*b*. The releasing layer 22*d* is formed on the elastic layer 22*c*. The base layer 22*a* includes an insulative heat-resistant resin material. The insulative heat-resistant resin material includes any one of a polyimide resin, a polyamide-imide resin, a PEEK resin, a PES resin, a PPS resin, and a fluorocarbon resin, for example. The base layer 22*a* has a thickness of 30 μm to 200 μm, considering the heat capacity and the strength of the layer.

The heating layer 22*b* includes a magnetic, conductive material. The magnetic, conductive material includes any one of nickel and stainless steel, for example. The heating layer 22*b* has a thickness of 1 μm to 20 μm. The heating layer 22*b* is formed on the base layer 22*a* by any one of plating, sputtering, and vacuum deposition.

According to one embodiment, the heating layer 22*b* includes a magnetic shunt alloy having the Curie point not lower than the fixing temperature and not greater than 300 degrees centigrade. Specifically, the magnetic shunt alloy includes an alloy of nickel, steel, and chrome. The preferred Curie point can be obtained by adjusting the quantity of the materials and the processing conditions. The heating layer 22*b* includes the magnetic, conductive material in which the Curie point is near the fixing temperature. Thus, the induction heating properly heats the heating layer 22*b*, without overheating the heating layer 22*b*.

The elastic layer 22*c* includes any one of silicone rubber and fluoro-silicone rubber. The elastic layer 22*c* has a thickness of 50 μm to 500 μm and an asker hardness of 5 to 50 degrees. Thus, the toner image transferred on the recording sheet P can be uniformly glossy.

The releasing layer 22*d* includes any one of a fluorocarbon resin, a mixture of the fluorocarbon resins, and a heat-resistant resin in which the fluorocarbon resins are dispersed. The fluorocarbon resin includes any one of a PTFE resin, a PFA resin, and an FEP resin. The releasing layer 22*d* has a thickness of 5 μm to 50 μm, preferably 10 μm to 30 μm. Thus, the toner may be easily released from the fixing belt 22, and the fixing belt 22 may have an appropriate flexibility. A primer layer (not shown) may be provided between the base layer 22*a* and the heating layer 22*b*, between the heating layer 22*b* and the elastic layer 22*c*, or between the elastic layer 22*c* and the releasing layer 22*d*.

Figure 11B:
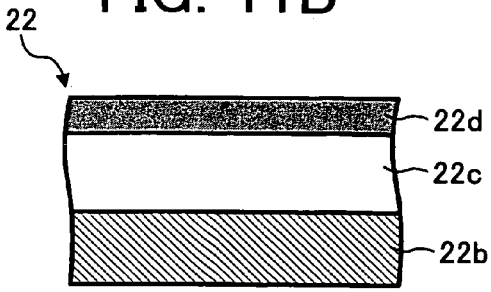
FIG. 11B is a cross-sectional view of another fixing belt of the fixing unit shown in FIG. 10.
Figure 11C:
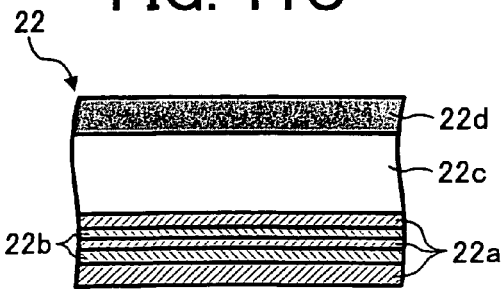
FIG. 11C is a cross-sectional view of another fixing belt of the fixing unit shown in FIG. 10.
Figure 11D:
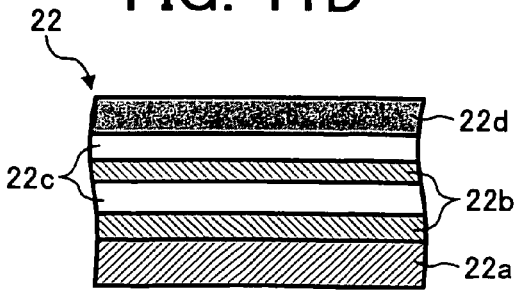
FIG. 11D is a cross-sectional view of another fixing belt of the fixing unit shown in FIG. 10.

According to one embodiment, the fixing belt 22 includes four layers as illustrated in FIG. 11A. However, the fixing belt 22 may include multiple layers as illustrated in FIGS. 11B, 11C, and 11D. The fixing belt 22 illustrated in FIG. 11B includes the heating layer 22*b*, the elastic layer 22*c*, and the releasing layer 22*d*. The heating layer 22*b* may include a resin material in which magnetic, conductive particles are dispersed. The resin material includes any one of a polyimide resin, a polyamide-imide resin, a PEEK resin, a PES resin, a PPS resin, and a fluorocarbon resin, for example. In this case, a quantity of the magnetic, conductive particles is in a range of 20 to 90 weight percent against a quantity of the resin material. Specifically, a dispersing device (not shown) disperses the magnetic, conductive particles in the varnished resin material. The dispersing device includes any one of a roll mill, a sand mill, and a centrifugal defoamer, for example. A solvent is added to properly adjust a viscosity of the dispersed resin material. The resin material is put into a mold to form the heating layer 22*b* having the preferred thickness.

The fixing belt 22 illustrated in FIG. 11C includes the base layer 22*a*, the heating layers 22*b*, the elastic layer 22*c*, and the releasing layer 22*d*. The base layer 22*a* includes a plurality of the heating layers 22*b*. The elastic layer 22*c* is formed on the base layer 22*a*. The releasing layer 22*d* is formed on the elastic layer 22*c*. The fixing belt 22 illustrated in FIG. 11D includes the base layer 22*a*, the heating layers 22*b*, the elastic layer 22*c*, and the releasing layer 22*d*. The elastic layer 22*c* includes a plurality of the heating layers 22*b*. The elastic layer 22*c* is formed on the base layer 22*a*. The releasing layer 22*d* is formed as a surface layer on the elastic layer 22*c*. The heating layers 22*b* illustrated in FIGS. 11B, 11C, and 11D may produce effects similar to the effects produced by the heating layer 22*b* illustrated in FIG. 11A.

Referring to FIG. 10, operations of a fixing process performed by the fixing unit 20*d* are explained below.

The auxiliary fixing roller 21 rotating in the rotating direction E drives and rotates the fixing belt 22 in the rotating direction H. The support roller 23 rotates in the rotating direction F. The pressure roller 30 rotates in the rotating direction I.

The high-frequency power source 49 applies a high-frequency alternating current of 10 kHz to 1 MHz to the magnetic flux generator 25. The magnetic flux generator 25 is formed in a U-like or loop-like shape. Magnetic lines of force are formed in a gap or a loop formed by the U-like or loop-like shape. Directions of the magnetic lines of force alternately switch in opposite directions to form an alternating magnetic field. When temperatures of the support roller 23 and the heating layer 22*b* are not greater than the Curie points, eddy currents are generated on the surface of the support roller 23 and in the heating layers 22*b*. Electric resistances of the support roller 23 and the heating layer 22*b* generate the Joule heat. The Joule heat is transferred to the fixing belt 22.

The fixing belt 22 is heated at a position (i.e., a face position) where the fixing belt 22 faces the magnetic flux generator 25. A heated portion of the fixing belt 22 passes under the thermistor. When the heated portion reaches the contact position, the heated portion heats and melts the toner image T on the recording sheet P conveyed in the direction Y.

The portion of the fixing belt 22 reaches the face position again. The operations described above are repeated to complete the fixing process.

When the temperatures of the support roller 23 and the heating layer 22*b* exceed the Curie points, the support roller 23 and the heating layer 22*b* generate less heat. Namely, the support roller 23 and the heating layer 22*b* lose their magnetic properties and the generation of the eddy currents is suppressed. Thus, the generation of the Joule heat is suppressed to prevent the temperatures of the support roller 23 and the heating layer 22*b* from increasing excessively.

As described above, according to one embodiment, the magnetic flux generator 25 surrounds the support roller 23 in a state that the magnetic flux generator 25 faces the outer circumferential surface of the support roller 23 via the fixing belt 22 and the inner circumferential surface of the support roller 23. The Curie points of the support roller 23 and the heating layer 22*b* are set to be near the fixing temperature. Therefore, the support roller 23 and the heating layer 22*b* effectively control their temperatures. Even when the toner image fixing is performed a number of times in a consecutive manner relative to the smaller-size recording sheets P or the fixing unit 20*d* accidentally stops operating, the fixing unit 20*d* prevents the surface temperature of the fixing belt 22 from increasing excessively.

The magnetic flux generator 25 and the holder 40 can be integrated. Thus, an improved efficiency in heating the support roller 23 and the fixing belt 22 can be stably maintained. Installation and maintenance of the fixing unit 20*d* can be performed with improved efficiency.

According to one embodiment, the fixing belt 22 functions as the fixing member. The fixing belt 22 and the support roller 23 function as the heaters. However, only one of the fixing belt 22 and the support roller 23 may be used as the heater. In this case, effects similar to the effects according to the present embodiment can be obtained.

Figure 12:
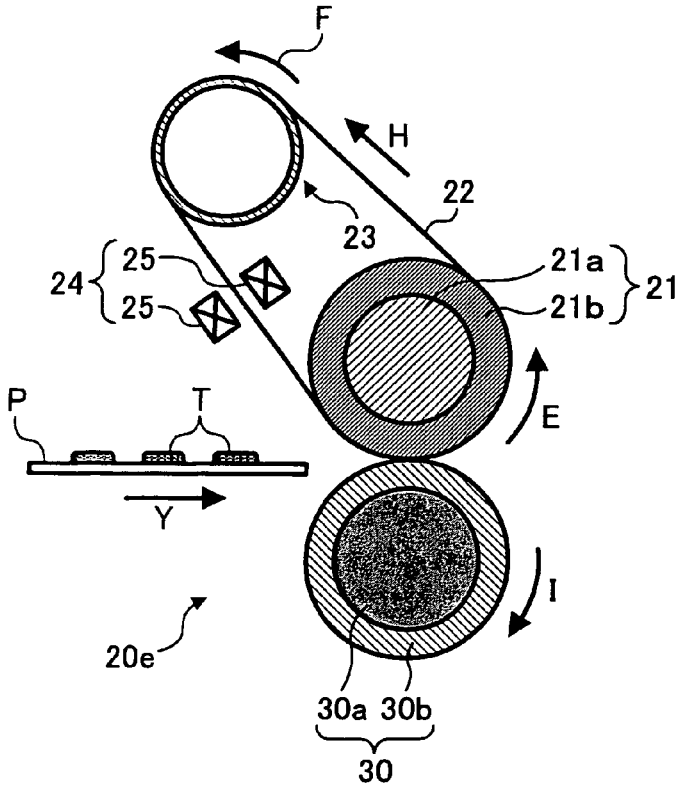
FIG. 12 is a cross-sectional view of a fixing unit according to another exemplary embodiment of the present invention.

Referring to FIG. 12, another exemplary embodiment of the present invention is explained.

A fixing unit 20*e* includes parts included in the fixing unit 20*d*, but does not include the heating layer 23*b*.

The fixing unit 20*e* is configured to fix the toner image T on the recording sheet P.

According to one embodiment, the fixing belt 22 functions as the fixing member and the heater.

The magnetic flux generator 25 faces outer and inner circumferential surfaces (i.e., front and back surfaces) of the fixing belt 22 at a position where the fixing belt 22 does not contact the support roller 23 and the auxiliary fixing roller 21. The magnetic flux generator 25 is disposed substantially parallel to the axial direction of the support roller 23, and extends in the axial direction of the support roller 23. The induction heater 24 is attachable and detachable to and from the fixing unit 20*e*.

The high-frequency power source 49 applies an alternating current to the magnetic flux generator 25. The magnetic flux generator 25 is formed in a U-like or loop-like shape. Magnetic lines of force are formed in a gap or a loop formed by the U-like or loop-like shape. When a temperature of the heating layer 22*b* is not greater than the Curie point, an eddy current is generated in the heating layer 22*b*. An electric resistance of the heating layer 22*b* generates the Joule heat. The Joule heat is transferred to the fixing belt 22. The heated fixing belt 22 heats and melts the toner image T on the recording sheet P conveyed in the direction Y.

According to one embodiment, the magnetic flux generator 25 surrounds the fixing belt 22 in a state that the magnetic flux generator 25 faces the outer and inner circumferential surfaces of the fixing belt 22. The Curie point of the heating layer 22*b* is set to be near the fixing temperature. Therefore, the heating layer 22*b* effectively controls its temperature. Even when the toner image fixing is performed a number of times in a consecutive manner relative to the smaller-size recording sheets P or the fixing unit 20*e* accidentally stops operating, the fixing unit 20*e* prevents the surface temperature of the fixing belt 22 from increasing excessively.

The magnetic flux generator 25 and the holder 40 can be integrated. Thus, an improved efficiency in heating the fixing belt 22 can be stably maintained. Installation and maintenance of the fixing unit 20*e* can be performed with improved efficiency.

Figure 13:
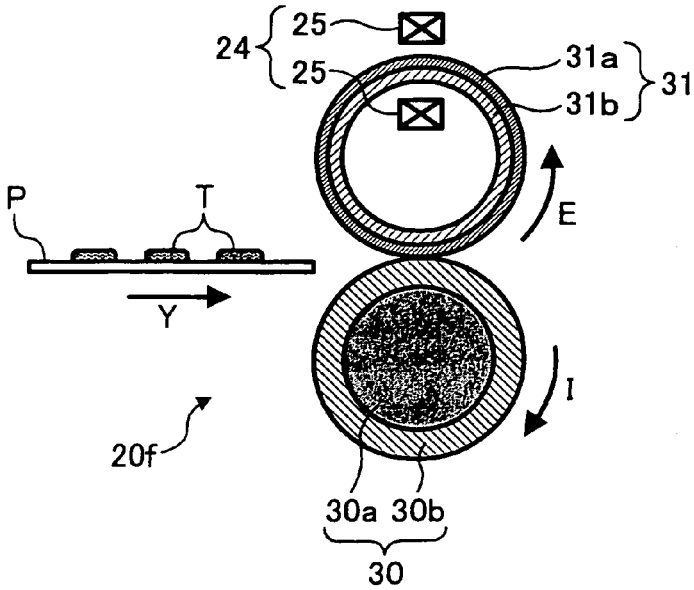
FIG. 13 is a cross-sectional view of a fixing unit according to another exemplary embodiment of the present invention.

Referring to FIG. 13, another exemplary embodiment of the present invention is explained.

A fixing unit 20*f* includes the induction heater 24, the pressure roller 30, and a fixing roller 31.

The induction heater 24 includes the magnetic flux generator 25. The pressure roller 30 includes the core 30*a* and the elastic layer 30*b*. The fixing roller 31 includes an elastic layer 31*a* and a heating layer 31*b*.

The fixing unit 20*f* is configured to fix the toner image T on the recording sheet P. The fixing roller 31 is configured to apply heat to the recording sheet P to fix the toner image T on the recording sheet P. The elastic layer 31*a* is configured to be formed on the heating layer 31*b*. The heating layer 31*b* is configured to generate heat by the magnetic flux generated by the magnetic flux generator 25.

According to the present embodiment, the fixing roller 31 functions as the heater and the fixing member.

The heating layer 31*b* includes a magnetic shunt alloy having the Curie point not lower than the fixing temperature and not greater than 300 degrees centigrade. The elastic layer 31*a* includes silicone rubber. The fixing roller 31 further includes a releasing layer (not shown). The releasing layer includes fluorochemical material.

The magnetic flux generator 25 surrounds the fixing roller 31 in a state that the magnetic flux generator 25 faces outer and inner circumferential surfaces (i.e., front and back surfaces) of the fixing roller 31. The induction heater 24 further includes a holder (not shown). The holder holds the magnetic flux generator 25 and positions the magnetic flux generator 25 against the fixing roller 31. The induction heater 24 is attachable and detachable to and from the fixing unit 20*f* through one end of the fixing unit 20*f* in an axial direction of the fixing roller 31.

An alternating current is applied to the magnetic flux generator 25. The alternating current has a frequency of 10 kHz to 1 MHz. The magnetic flux generator 25 is formed in a U-like or loop-like shape. Magnetic lines of force are formed in a gap or a loop formed by the U-like or loop-like shape. When a temperature of the heating layer 31*b* is not greater than the Curie point, an eddy current is generated in the heating layer 31*b*. An electric resistance of the heating layer 31*b* generates Joule heat. The Joule heat is transferred to the fixing roller 31. The heated fixing roller 31 heats and melts the toner image T on the recording sheet P conveyed in the direction Y.

According to one embodiment, when the temperature of the heating layer 31 exceeds the Curie point, the Joule heat generated by the heating layer 31*b* is effectively controlled.

According to one embodiment, the magnetic flux generator 25 surrounds the fixing roller 31 in a state that the magnetic flux generator 25 faces the outer and inner circumferential surfaces of the fixing roller 31. The Curie point of the heating layer 31*b* is set to be near the fixing temperature. Therefore, the heating layer 31*b* effectively controls its own temperature. Even when the toner image fixing is performed a number of times in a consecutive manner relative to the smaller-size recording sheets P or the fixing unit 20*f* accidentally stops operating, the fixing unit 20*f* prevents the surface temperature of the fixing roller 31 from increasing excessively.

The magnetic flux generator 25 and the holder can be integrated. Thus, an improved efficiency in heating the fixing roller 31 can be stably maintained. Installation and maintenance of the fixing unit 20*f* can be performed with improved efficiency.

Referring to FIGS. 14A, 14B, 15A, 15B, 16A, 16B, 17A, and 17B, experiments of the above effects are explained.

Figure 14A:
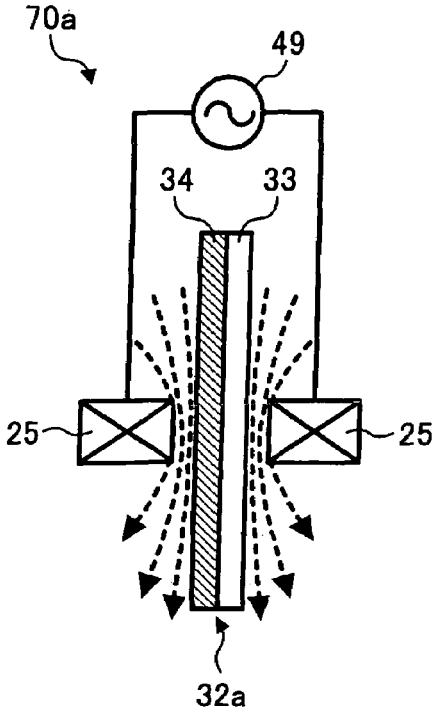
FIG. 14A is a cross-sectional view of an experimental device.
Figure 14B:
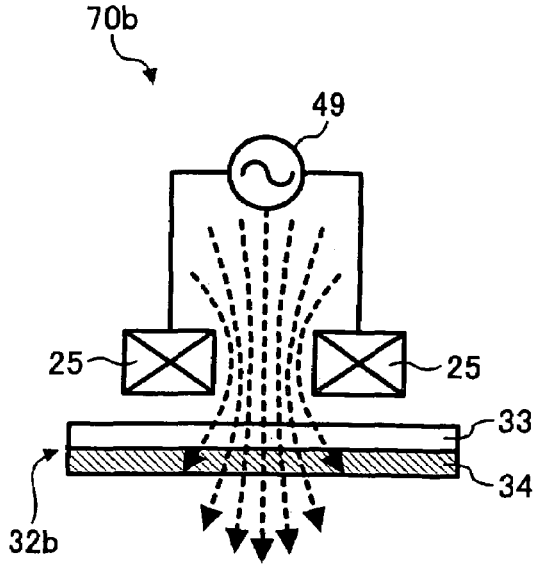
FIG. 14B is a cross-sectional view of another experimental device.

FIGS. 14A and 14B illustrate experimental devices 70*a* and 70*b*. The experimental device 70*a* includes the magnetic flux generator 25, a test piece 32*a*, and the high-frequency power source 49. The experimental device 70*b* includes the magnetic flux generator 25, a test piece 32*b*, and the high-frequency power source 49. Each of the test pieces 32*a* and 32*b* includes a heating layer 33 and a conductive layer 34.

Each of the experimental devices 70*a* and 70*b* is configured to include an induction heater equivalent to the induction heater 24 and a heating layer equivalent to the heating layer 22*b*, 23*b*, or 31*b*. The test pieces 32*a* and 32*b* are configured to function as the heaters. The heating layer 33 is configured to generate heat by the magnetic flux generated by the magnetic flux generator 25. The conductive layer 34 is configured to form a current-carrying portion.

As illustrated in FIG. 14A, the magnetic flux generator 25 surrounds the test piece 32*a* in a state that the magnetic flux generator 25 faces a front surface (i.e., the heating layer 33) and a back surface (i.e., the conductive layer 34) of the test piece 32*a*. The experimental device 70*a* has a structure of the fixing unit 20*a*, 20*b*, 20*c*, 20*d*, 20*e*, or 20*f*.

As illustrated in FIG. 14B, the magnetic flux generator 25 faces only a front surface (i.e., the heating layer 33) of the text piece 32*b*. The experimental device 70*b* has a structure of a background fixing unit.

Figure 15A:
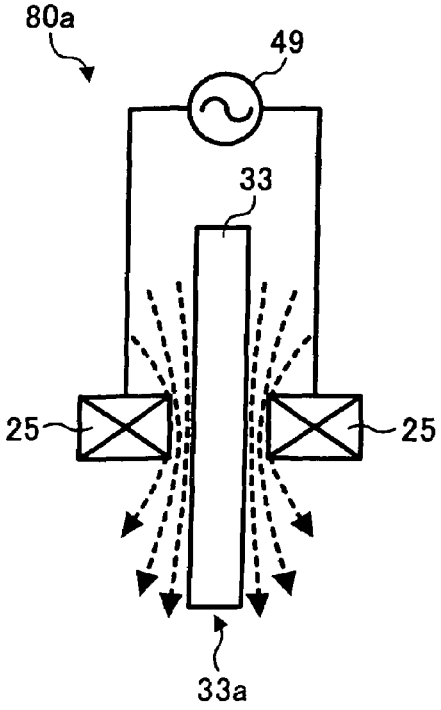
FIG. 15A is a cross-sectional view of another experimental device.
Figure 15B:
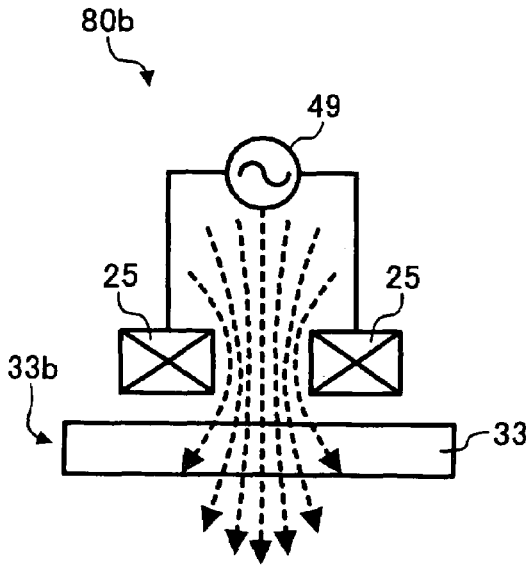
FIG. 15B is a cross-sectional view of another experimental device.

FIGS. 15A and 15B illustrate experimental devices 80*a* and 80*b*. The experimental device 80*a* includes the magnetic flux generator 25, a test piece 33*a*, and the high-frequency power source 49. The experimental device 80*b* includes the magnetic flux generator 25, a test piece 33*b*, and the high-frequency power source 49.

The experimental devices 80*a* and 80*b* are configured to include an induction heater equivalent to the induction heater 24 and a heating layer equivalent to the heating layer 22*b*, 23*b*, or 31*b*. The test pieces 33*a* and 33*b* are configured to function as the heaters.

As illustrated in FIG. 15A, the magnetic flux generator 25 surrounds the test piece 33*a* in a state that the magnetic flux generator 25 faces front and back surfaces (i.e., the heating layer 33) of the test piece 33*a*. The experimental device 80*a* has a structure of the fixing unit 20*a*, 20*b*, 20*c*, 20*d*, 20*e*, or 20*f*.

As illustrated in FIG. 15B, the magnetic flux generator 25 faces only a front surface (i.e., the heat generating layer 33) of the test piece 33*b*. The experimental device 80*b* has a structure of another background fixing unit.

The heating layer 33 includes a magnetic shunt alloy having a Curie point of 240 degrees centigrade. The heating layer 33 has an area of 25 mm×50 mm and a thickness of 0.22 mm. The conductive layer 34 includes aluminum. The conductive layer 34 has an area of 25 mm×50 mm and a thickness of 0.3 mm or 0.8 mm.

The high-frequency power source 49 applies an alternating current having power of 200 W to 1,200 W and an exciting frequency of 36 kHz or 130 kHz to the magnetic flux generator 25. Thus, the magnetic lines of force illustrated with broken line arrows in FIGS. 14A, 14B, 15A, and 15B are generated near the magnetic flux generator 25.

Figure 16A:
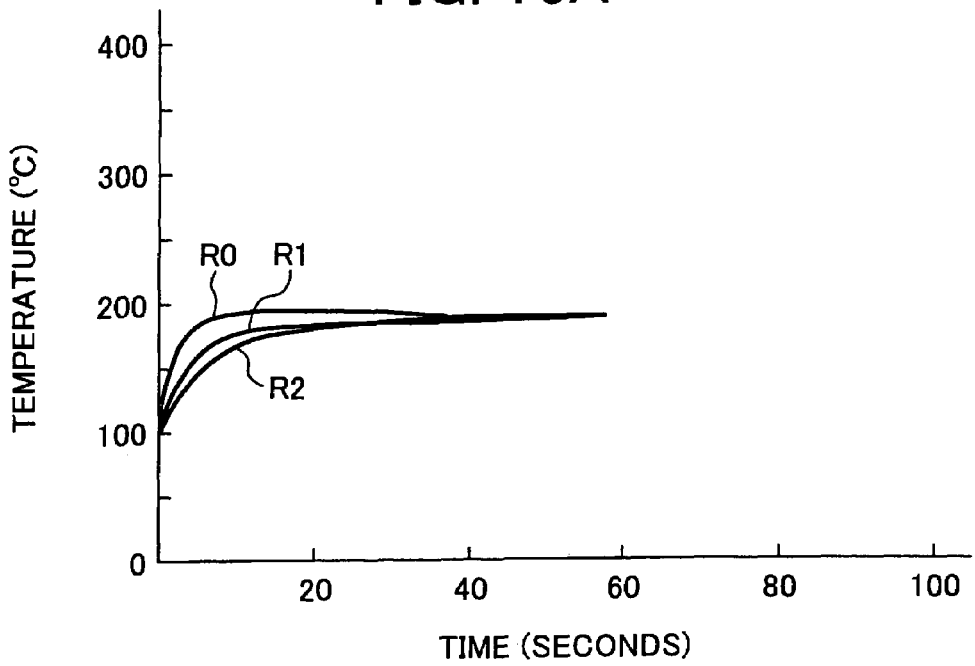
FIG. 16A is a graph illustrating experimental results obtained by using the experimental devices shown in FIGS. 14A and 15A.
Figure 16B:
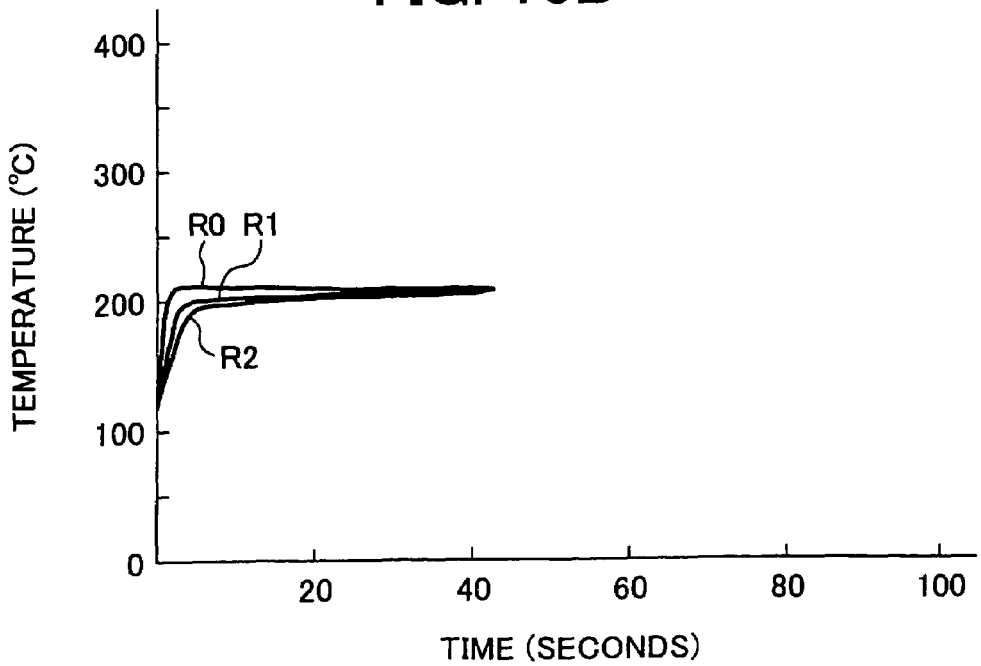
FIG. 16B is a graph illustrating another experimental results obtained by using the experimental devices shown in FIGS. 14A and 15A.
Figure 17A:
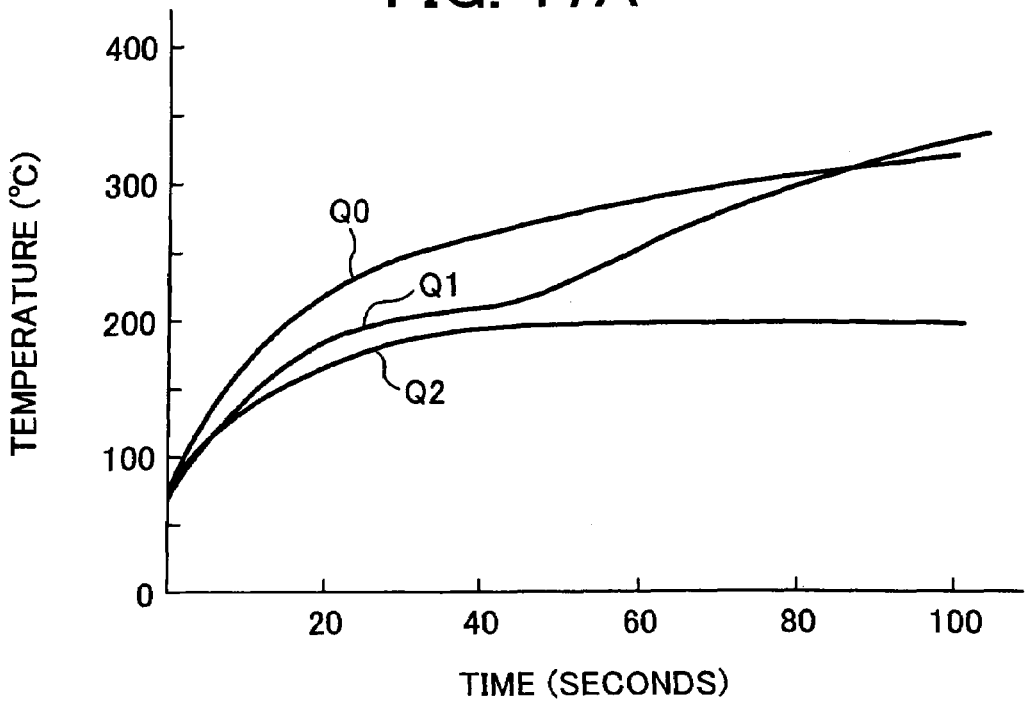
FIG. 17A is a graph illustrating experimental results obtained by using the experimental devices shown in FIGS. 14B and 15B.
Figure 17B:
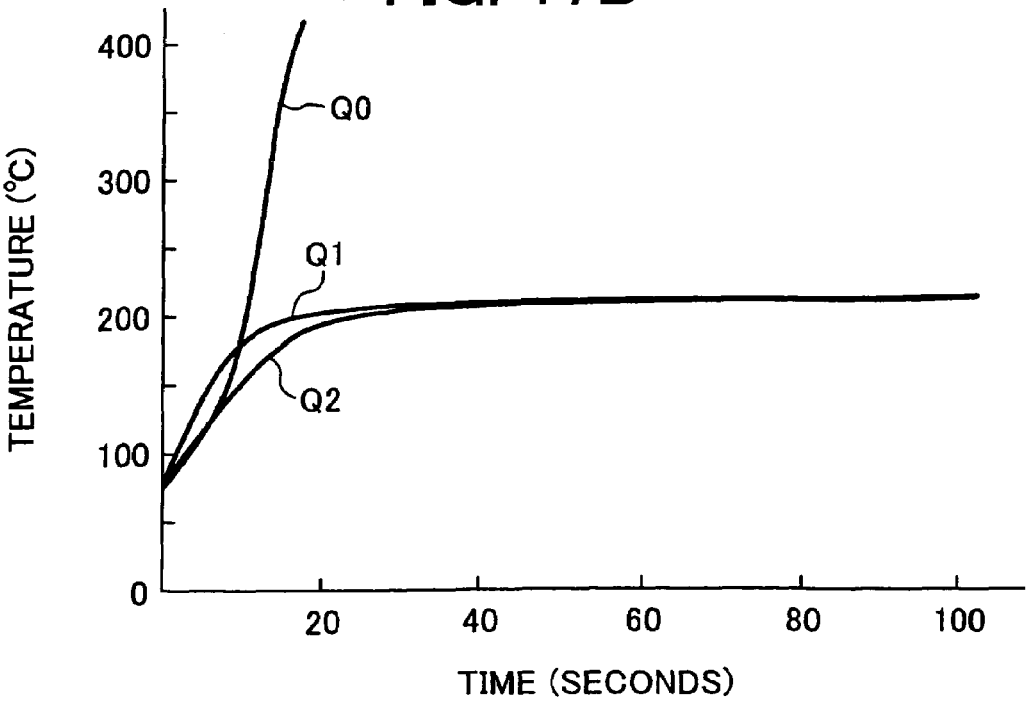
FIG. 17B is a graph illustrating another experimental results obtained by using the experimental devices shown in FIGS. 14B and 15B.

FIGS. 16A and 16B illustrate results of experiments performed by using the experimental devices 70*a* and 80*a*. FIGS. 17A and 17B illustrate results of experiments performed by using the experimental devices 70*b* and 80*b*. Horizontal axes represent a time elapsed after induction heating starts. Vertical axes represent a surface temperature of the heating layer 33.

FIG. 16A illustrates a relationship between the time and the temperature when the high-frequency power source 49 applies an alternating current having a frequency of 36 kHz. FIG. 16B illustrates a relationship between the time and the temperature when the high-frequency power source 49 applies an alternating current having a frequency of 130 kHz. In FIGS. 16A and 16B, solid lines R0 represent results of experiments performed by using the experimental device 80*a*. Solid lines R1 represent results of experiments performed by using the experimental device 70*a* including the conductive layer 34 having the thickness of 0.3 mm. Solid lines R2 represent results of experiments performed by using the experimental device 70*a* including the conductive layer 34 having the thickness of 0.8 mm.

FIG. 17A illustrates a relationship between the time and the temperature when the high-frequency power source 49 applies an alternating current having the frequency of 36 kHz. FIG. 17B illustrates a relationship between the time and the temperature when the high-frequency power source 49 applies an alternating current having the frequency of 130 kHz. In FIGS. 17A and 17B, solid lines Q0 represent results of experiments performed by using the experimental device 80*b*. Solid lines Q1 represent results of experiments performed by using the experimental device 70*b* including the conductive layer 34 having the thickness of 0.3 mm. Solid lines Q2 represent results of experiments performed by using the experimental device 70*b* including the conductive layer 34 having the thickness of 0.8 mm.

The experimental results shown in FIGS. 16A and 16B reveal that the surface temperature of the heating layer 33 did not increase excessively after the surface temperature of the heating layer 33 reached the Curie point, regardless of whether the test pieces 32*a* and 33*a* included the conductive layer 34 or not or whether the frequency of the alternating current was 36 kHz or 130 kHz. The experimental results shown in FIG. 17A reveal that the surface temperature of the heating layer 33 increased excessively unless the conductive layer 34 had the thickness of 0.8 mm or more when the alternating current had the frequency of 36 kHz. The experimental results shown in FIG. 17B reveal that the surface temperature of the heating layer 33 increased excessively unless the conductive layer 34 had the thickness of 0.3 mm or more when the alternating current had the frequency of 130 kHz. Thus, when the magnetic flux generator 25 faces only the front surface of the heating layer 33, it is necessary to provide the conductive layer 34, which is nonmagnetic and has a low resistance, on the back surface of the heating layer 33 to stabilize a temperature of the heating layer 33. However, the time for achieving the stabilized temperature in FIGS. 17A and 17B is much longer than for FIGS. 16A and 16B.

The above experimental results reveal that the heating layer 33 of the present invention effectively generated heat and controlled its temperature when the magnetic flux generator 25 having the U-like or loop-like shape surrounded the heating layer 33. These effects can be obtained even when the conductive layer 34 is not provided if the setup of the above discussed embodiments is used. Therefore, the heating layer 33 can be simplified and produced at a low cost. Because it is not necessary to provide the conductive layer 34 on the back surface of the heating layer 33, a problematic separation of the conductive layer 34 from the heating layer 33 does not occur in the device of the above discussed embodiments.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

The invention claimed is:

1. An image forming apparatus, comprising:

an image forming unit configured to form a toner image on a recording sheet; and a fixing unit configured to fix the toner image on the recording sheet, the fixing unit including an induction heater configured to generate a magnetic field, and a heater configured to generate heat when placed in the magnetic field, the induction heater including an exciting coil configured to generate a magnetic flux to heat the heater, the exciting coil disposed to surround the heater, and a holder configured to hold the exciting coil and to position the exciting coil against the heater.

2. The image forming apparatus according to claim 1, wherein the holder is configured to hold the heater.

3. The image forming apparatus according to claim 1, further comprising:

a positioner configured to position the holder and the heater in the fixing unit.

4. The image forming apparatus according to claim 1, wherein the induction heater is configured to be attached to and to be detached from the heater through one end in an axial direction of the heater.

5. The image forming apparatus according to claim 1, wherein the exciting coil is formed in a U-like shape.

6. The image forming apparatus according to claim 1, wherein the exciting coil is formed in a U-like shapes, and the heater is placed in a gap of the exciting coil.

7. The image forming apparatus according to claim 1, wherein the exciting coil includes one U-like shape member.

8. The image forming apparatus according to claim 1, wherein the exciting coil includes a plurality of U-like shape members.

9. The image forming apparatus according to claim 1, wherein the exciting coil is formed in a loop-like shape.

10. The image forming apparatus according to claim 1, wherein the exciting coil is formed in a loop-like shapes, and the heater is placed inside a loop of the exciting coil.

11. The image forming apparatus according to claim 1, wherein the induction heater is integrated with the heater, and the induction heater and the heater are configured to be attached to and to be detached from the fixing unit through one end in an axial direction of the heater.

12. The image forming apparatus according to claim 11, wherein the exciting coil winds around front and back surfaces of the heater a plurality of times.

13. The image forming apparatus according to claim 1, further comprising:

a power source configured to apply an alternating current to the exciting coil; and a connector configured to connect the exciting coil to the power source, the connector held by the holder.

14. The image forming apparatus according to claim 13, wherein the connector is configured to connect the exciting coil to the power source to form one alternating current channel in the exciting coil.

15. The image forming apparatus according to claim 14, wherein the connector includes two input-output terminals.

16. The image forming apparatus according to claim 12, wherein the holder is configured to hold the exciting coil to create first and second gaps between the exciting coil and each of the front and back surfaces of the heater in a direction perpendicular to an axial direction of the heater, lengths of the first and second gaps being in a range of 0.5 mm to 50 mm.

17. The image forming apparatus according to claim 1, wherein the exciting coil includes a plurality of single wires bunched, twisted, and insulated from each other.

18. The image forming apparatus according to claim 1, wherein the exciting coil includes copper.

19. The image forming apparatus according to claim 1, wherein the holder includes a heat-resistant, non-magnetic material.

20. The image forming apparatus according to claim 19, wherein the non-magnetic material includes any one of a polyimide resin, a polyamide resin, a polyamide-imide resin, a PEEK (polyetheretherketone) resin, a PES (polyethersulfone) resin, a PPS (polyphenylene sulfide) resin, a PBI (polybenzimidazole) resin, and ceramic.

21. The image forming apparatus according to claim 1, wherein the heater comprises a heating layer configured to generate heat by the magnetic flux generated by the exciting coil and to have a Curie point not greater than 300 degrees centigrade.

22. The image forming apparatus according to claim 21, wherein the heating layer includes a magnetic shunt alloy.

23. The image forming apparatus according to claim 1, further comprising:

a fixing member configured to melt the toner image and to be heated by the heater.

24. The image forming apparatus according to claim 23, further comprising:

an auxiliary fixing roller configured to support the fixing member, wherein the fixing member is formed in a belt shape and is extended in an endless loop form, and the heater is formed in a roller shape and is configured to support the fixing member.

25. The image forming apparatus according to claim 24, wherein the exciting coil is disposed at a position facing both an outer circumferential surface of the heater via the fixing member and an inner circumferential surface of the heater.

26. The image forming apparatus according to claim 24, further comprising:

a pressure roller configured to apply pressure to the recording sheet, wherein the auxiliary fixing roller is configured to receive pressure from the pressure roller via the recording sheet and the fixing member.

27. The image forming apparatus according to claim 1, wherein the heater includes a fixing member configured to melt the toner image.

28. The image forming apparatus according to claim 27, further comprising:

at least two rollers configured to support the fixing member, wherein the fixing member is formed in a belt shape and is extended in an endless loop form, and exciting coil is disposed at a position facing outer and inner circumferential surfaces of the fixing member.

29. The image forming apparatus according to claim 28, further comprising:

a pressure roller configured to apply pressure to the recording sheet, wherein the at least two rollers include a support roller configured to support the fixing member at one end of the endless loop form, and an auxiliary fixing roller configured to support the fixing member at another end of the endless loop form and to receive pressure from the pressure roller via the recording sheet and the fixing member.

30. The image forming apparatus according to claim 29, wherein the exciting coil is disposed at a position facing an inner circumferential surface of the fixing member via the support roller.

31. The image forming apparatus according to claim 23, further comprising:

a pressure roller configured to apply pressure to the recording sheet, wherein the fixing member is formed in a roller shape and is configured to contact the pressure roller, and the exciting coil is disposed at a position facing outer and inner circumferential surfaces of the fixing member.

32. An image forming apparatus, comprising:

means for forming a toner image on a recording sheet; and means for fixing the toner image on the recording sheet, the means for fixing including means for generating a magnetic field, and means for generating heat when placed in the magnetic field, the means for generating the magnetic field: including means for generating a magnetic flux to heat the means for generating heat, the means for generating a magnetic flux disposed to surround the means for generating heat, and means for holding the means for generating a magnetic flux and positioning the means for generating a magnetic flux against the means for generating heat, wherein the means for generating a magnetic flux is an exciting coil.

33. An image forming method, comprising:

forming a toner image on a recording sheet; and fixing the toner image on the recording sheet, the fixing including generating a magnetic flux by applying an alternating current to an exciting coil, the exciting coil held and positioned by a holder so as to surround a heater, the generated magnetic flux heating the heater to a predetermined temperature, and rotating the heater, to fix the toner image on the recording sheet by a portion of the heater having the predetermined temperature.

34. A fixing unit configured to fix a toner image on a recording sheet, comprising:

an induction heater configured to generate a magnetic field; and a heater configured to generate heat when placed in the magnetic field, the induction heater including an exciting coil configured to generate a magnetic flux to heat the heater, the exciting coil disposed to surround the heater, and a holder configured to hold the exciting coil and to position the exciting coil against the heater.

35. An induction heater configured to generate a magnetic field, comprising:

an exciting coil configured to generate a magnetic flux to heat a heater configured to generate heat by the magnetic flux, and the exciting coil disposed to surround the heater; and a holder configured to hold the exciting coil and to position the exciting coil against the heater.

* * * * *